US006115684A

United States Patent [19]

Kawahara et al.

[11] Patent Number: 6,115,684

[45] Date of Patent: Sep. 5, 2000

[54] METHOD OF TRANSFORMING PERIODIC SIGNAL USING SMOOTHED SPECTROGRAM, METHOD OF TRANSFORMING SOUND USING PHASING COMPONENT AND METHOD OF ANALYZING SIGNAL USING OPTIMUM INTERPOLATION FUNCTION

[75] Inventors: Hideki Kawahara; Ikuyo Masuda, both of Kyoto, Japan

[73] Assignee: ATR Human Information Processing Research Laboratories, Kyoto, Japan

[21] Appl. No.: 08/902,546

[22] Filed: Jul. 29, 1997

[30] Foreign Application Priority Data

Jul. 30, 1996 [JP] Japan ..... 8-200845
Dec. 24, 1996 [JP] Japan ..... 8-344247

[51] Int. Cl.[7] ..... G10L 101/02

[52] U.S. Cl. ..... 704/203

[58] Field of Search ..... 704/200, 201, 704/203, 204, 205, 211

[56] References Cited

U.S. PATENT DOCUMENTS

| | | | |
|---|---|---|---|
| 4,896,285 | 1/1990 | Ishikawa et al. | 364/724.01 |
| 5,029,211 | 7/1991 | Ozawa | 381/36 |
| 5,214,708 | 5/1993 | McEachern | 381/48 |
| 5,235,534 | 8/1993 | Potter | 364/724.01 |
| 5,327,521 | 7/1994 | Savic et al. | 395/2.81 |
| 5,369,730 | 11/1994 | Yajima | 395/2.76 |
| 5,414,796 | 5/1995 | Jacobs et al. | 395/2.3 |

(List continued on next page.)

FOREIGN PATENT DOCUMENTS

| | | |
|---|---|---|
| WO 93/19378 | 9/1993 | WIPO . |
| WO 94/18666 | 8/1994 | WIPO . |
| WO 95/16259 | 6/1995 | WIPO . |

OTHER PUBLICATIONS

Harris, "On the Use of Windows for Harmonic Analysis with the Discrete Fourier Transform", Proceedings of the IEEE, vol. 66 #1, Jan. 1978.

Potamianos et al, "Speech Formant Frequency and Bandwidth Tracking Using Multiband Energy Demodulation", ICASSP '95, Acoustics, Speech and Signal Processing, May 1995.

Orr, "A Gabor sampling Theorem and Some Time–Bandwidth Implications", ICASSP '94.

Maragos, "Speech nonlinearities, modulations, and energy operators", ICASSP '91.

Qian, "Signal approximation via data–adaptive normalized Gaussian functions", ICASSP '92.

Power Spectrum Envelope (PSE) Speech Sound Analysis/Synthesis System (with English Translation).

Periodic Sampling Basis and Its Biorthonormal Basis for The Signal Spaces of Piecewise Polynominals. (with English Translation).

A Formant Extraction not Influenced by Pitch Frequency Variations (with English Translation).

Speech Analysis Synthesis System Using the Log Magnitude Approximation Filter. (with English Translation).

*Primary Examiner*—Krista Zele
*Assistant Examiner*—Michael N. Opsasnick
*Attorney, Agent, or Firm*—McDermott, Will & Emery

[57] ABSTRACT

At a smoothing spectrogram calculation portion, a triangular interpolation function having a frequency width twice that of the fundamental frequency of a signal is obtained based on information on the fundamental frequency of the signal. The interpolation function and a spectrum obtained at an adaptive frequency analysis portion are convoluted in the direction of frequency. Then, using a triangular interpolation function having a time length twice that of a fundamental period, the spectrum interpolated in the frequency direction described above is further interpolated in the temporal direction, in order to produce a smoothed spectrogram having the space between grid points on the time-frequency plane filled with the surface of a bilinear function. Using the smoothed spectrogram, a speech sound is transformed. Therefore, the influence of periodicity in the frequency direction and the temporal direction can be reduced.

11 Claims, 23 Drawing Sheets

U.S. PATENT DOCUMENTS

| | | | |
|---|---|---|---|
| 5,485,395 | 1/1996 | Smith | 364/485 |
| 5,524,173 | 6/1996 | Puckette | 395/2.77 |
| 5,570,305 | 10/1996 | Fattouche et al. | 364/715.02 |
| 5,576,978 | 11/1996 | Kitayoshi | 364/576 |
| 5,577,159 | 11/1996 | Shoham | 395/2.15 |
| 5,630,012 | 5/1997 | Nishiguchi et al. | 395/2.17 |
| 5,630,013 | 5/1997 | Suzuki et al. | 395/2.25 |
| 5,657,420 | 8/1997 | Jacobs et al. | 395/2.32 |
| 5,675,701 | 10/1997 | Kleijn et al. | 395/2.31 |
| 5,686,683 | 11/1997 | Freed | 84/625 |
| 5,710,863 | 1/1998 | Chen | 395/2.39 |
| 5,715,365 | 2/1998 | Griffin et al. | 395/2.23 |
| 5,737,717 | 4/1998 | Akagiri et al. | 704/205 |
| 5,778,338 | 7/1998 | Jacobs et al. | 704/223 |
| 5,790,759 | 8/1998 | Chen | 395/2.39 |

METHOD OF TRANSFORMING PERIODIC SIGNAL USING SMOOTHED SPECTROGRAM, METHOD OF TRANSFORMING SOUND USING PHASING COMPONENT AND METHOD OF ANALYZING SIGNAL USING OPTIMUM INTERPOLATION FUNCTION

BACKGROUND OF THE INVENTION

1. Field of the Invention

The present invention relates generally to a periodic signal transformation method, a sound transformation method and a signal analysis method, and more particularly to a periodic signal transformation method for transforming sound, a sound transformation method and a signal analysis method for analyzing sound.

2. Description of the Background Art

When, in the analysis/synthesis of speech sounds, the intonation of speech sound is controlled or when the speech sounds are synthesized for editorial purposes to provide a naturally sounding intonation, the fundamental frequency of the speech sound should be converted while maintaining the tone of the original speech sound. When sounds in the nature world are sampled for use as a sound source for an electronic musical instrument, the fundamental frequency should be converted while keeping the tone constant. In such conversion, a fundamental frequency should be set finer than the resolution determined by the fundamental period. Meanwhile, if speech sounds are changed in order to conceal the individual features of an informant in broadcasting or the like for the purpose of protecting his/her privacy, the tone should be changed with the sound pitch unchanged sometimes, or both the tone and sound pitch should be changed otherwise.

There is an increasing demand for reuse of existing speech sound resources such as synthesizing the voices of different actors into a new voice without actually employing a new actor. As the society ages, there will be more people with a difficulty of hearing speech sound or music due to various forms of hearing impairment or perception impairment. There is therefore a strong demand for a method of changing the speed, frequency band, and the pitch of speech sound to be adapted to their deteriorated hearing or perception abilities with no loss of the original information.

A first conventional technique for achieving such an object is for example disclosed by "Speech Analysis Synthesis System Using the Log Magnitude Approximation Filter" by Satoshi Imai, Tadashi Kitamura, Journal of the Institute of Electronic and Communication Engineers, 78/6, Vol. J61-A, No. 6, pp. 527–534. The document discloses a method of producing a spectral envelope, and according to the method a model representing a spectral envelope is assumed, the parameters of the model are optimized by approximation taking into consideration of the peak of spectrum under an appropriate evaluation function.

A second conventional technique is disclosed by "A Formant Extraction not Influenced by Pitch Frequency Variations" by Kazuo Nakata, Journal of Japanese Acoustic Sound Association, Vol. 50, No. 2 (1994), pp. 110–116. The technique combines the idea of periodic signals into a method of estimating parameters for autoregressive model.

As a third conventional technique, a method of processing speech sound referred to as PSOLA by reduction/expansion of waveforms and time-shifted overlapping in the temporal domain is known.

Any of the above first and second conventional techniques cannot provide correct estimation of a spectral envelope unless the number of parameters to describe a model should be appropriately determined, because these techniques are based on the assumption of a specified model. In addition, if the nature of a signal source is different from an assumed model, a component resulting from the periodicity is mixed into the estimated spectral envelope, and an even larger error may result.

Furthermore, the first and second conventional techniques require iterative operations for convergence in the process of optimization, and therefore are not suitable for applications with a strict time limitation such as a real-time processing.

In addition, according to the first and second conventional techniques, the periodicity of a signal cannot be specified with a higher precision than the temporal resolution determined by a sampling frequency, because the sound source and spectral envelope are separated as a pulse train and a filter, respectively in terms of the control of the periodicity.

According to the third technique, if the periodicity of the sound source is changed by about 20% or more, the speech sound is deprived of its natural quality, and the sound cannot be transformed in a flexible manner.

SUMMARY OF THE INVENTION

One object of the invention is to provide a periodic signal transformation method without using a spectral model and capable of reducing the influence of the periodicity.

Another object of the invention is to provide a sound transformation method capable of precisely setting an interval with a higher resolution than the sampling frequency of the sound.

Yet another object of the invention is to provide a signal analysis method capable of producing a spectral and a spectrogram removed of the influence of excessive smoothing.

An additional object of the invention is to provide a signal analysis method capable of producing a spectral and a spectrogram with no point to be zero.

The periodic signal transformation method according to a first aspect of the invention includes the steps of transforming the spectrum of a periodic signal given in discrete spectrum into continuous spectrum represented in a piecewise polynomial, and converting the periodic signal into another signal using the continuous spectrum. In the step of transforming the spectrum of the periodic signal given in discrete spectrum into a continuous spectrum represented in a piecewise polynomial, an interpolation function and the discrete spectra on the frequency axis are convoluted to produce the continuous spectrum.

By the periodic signal transformation method according to the first aspect of the invention, the continuous spectrum, in other words, the smoothed spectrum is used to convert the periodic signal into another signal. The influence of the periodicity in the direction of frequency is reduced accordingly.

A periodic signal transformation method according to a second aspect of the invention includes the steps of producing a smoothed spectrogram by means of interpolation in a piecewise polynomial, using information on grid points represented on the spectrogram of a periodic signal and determined by the interval of the fundamental periods and the interval of the fundamental frequencies, and converting the periodic signal into another signal using the smoothed spectrogram. Information on grid points determined by the interval of the fundamental periods and the interval of the fundamental frequencies represented on the spectrogram of the periodic signal is used for interpolation in a piecewise polynomial, therefore in the step of producing the smoothed spectrogram, an interpolation function on the frequency axis and the spectrogram of the periodic signal are convoluted in the direction of the frequency, and an interpolation function on the temporal axis and the spectrogram resulting from the convolution is convoluted in the temporal direction to produce a smoothed spectrogram.

By the periodic signal transformation method according to the second aspect of the invention, the smoothed spectrogram is used to convert the periodic signal into another signal. The influence of the periodicity in the frequency direction and temporal direction is therefore reduced. Balanced temporal and frequency resolutions can be determined accordingly.

A sound transformation method according to a third aspect of the invention includes the steps of producing an impulse response using the product of a phasing component and a sound spectrum, and converting a sound into another sound by adding up the impulse response on a time axis while moving the impulse response by a cycle of interest. A sound source signal resulting from the phasing component has a power spectrum the same as the impulse and energy dispersed timewise.

By the sound transformation method according to the third aspect of the invention, the sound source signal resulting from the phasing component has a power spectrum the same as the impulse and energy dispersed timewise. This is why a natural tone can be created. Furthermore, using such a phasing component enables an interval to be precisely set with a resolution finer than the sampling frequency of the sound.

A method of analyzing a signal according to a fourth aspect of the invention includes the steps of hypothesizing that a time frequency surface representing a mechanism to produce a nearly periodic signal whose characteristic changes with time is represented by a product of a piecewise polynomial of time and a piecewise polynomial of frequency, extracting a prescribed range of the nearly periodic signal with a window function, producing a first spectrum from the nearly periodic signal in the extracted range, producing an optimum interpolation function in the frequency direction based on the representation of the window function in the frequency region and a base of a space represented by the piecewise polynomial of frequency, and producing a second spectrum by convoluting the first spectrum and the optimum interpolation function in the frequency direction. The optimum interpolation function in the frequency direction minimizes an error between the second spectrum and a section along the frequency axis of the time frequency surface.

By the signal analysis method according to the fourth aspect of the invention, interpolation is performed using the optimum interpolation function in the frequency direction to remove the influence of excessive smoothing, so that the fine structure of the spectrum will not be excessively smoothed.

Furthermore, according to the signal analysis method according to the fourth aspect of the invention, interpolation is preferably performed using an optimum interpolation function in the time direction to remove the influence of excessive smoothing, so that the fine structure of a spectrogram will not be excessively smoothed.

A signal analysis method according to a fifth aspect of the invention includes the steps of producing a first spectrum for a nearly periodic signal whose characteristic changes with time using a first window function, producing a second window function using a prescribed window function, producing a second spectrum for the nearly periodic signal using the second window function, and producing an average value of the first and second spectra through transformation by square or a monotonic non-negative function thereby forming a resultant average value into a third spectrum. The step of producing the second window function includes the steps of arranging prescribed window functions at an interval of a fundamental frequency on both sides of the origin, inverting the sign of one of the prescribed window functions thus arranged, and combining the window function having its sign inverted and the other window function to produce the second window function.

In the method of signal analysis according to the fifth aspect of the invention, the average for the first spectrum obtained using the first window function and the second spectrum obtained using the second window function which is complimentary to the first window function is produced through transformation by square or a monotonic non-negative function, and the average is used as the third spectrum. Thus produced third spectrum has no point to be zero.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
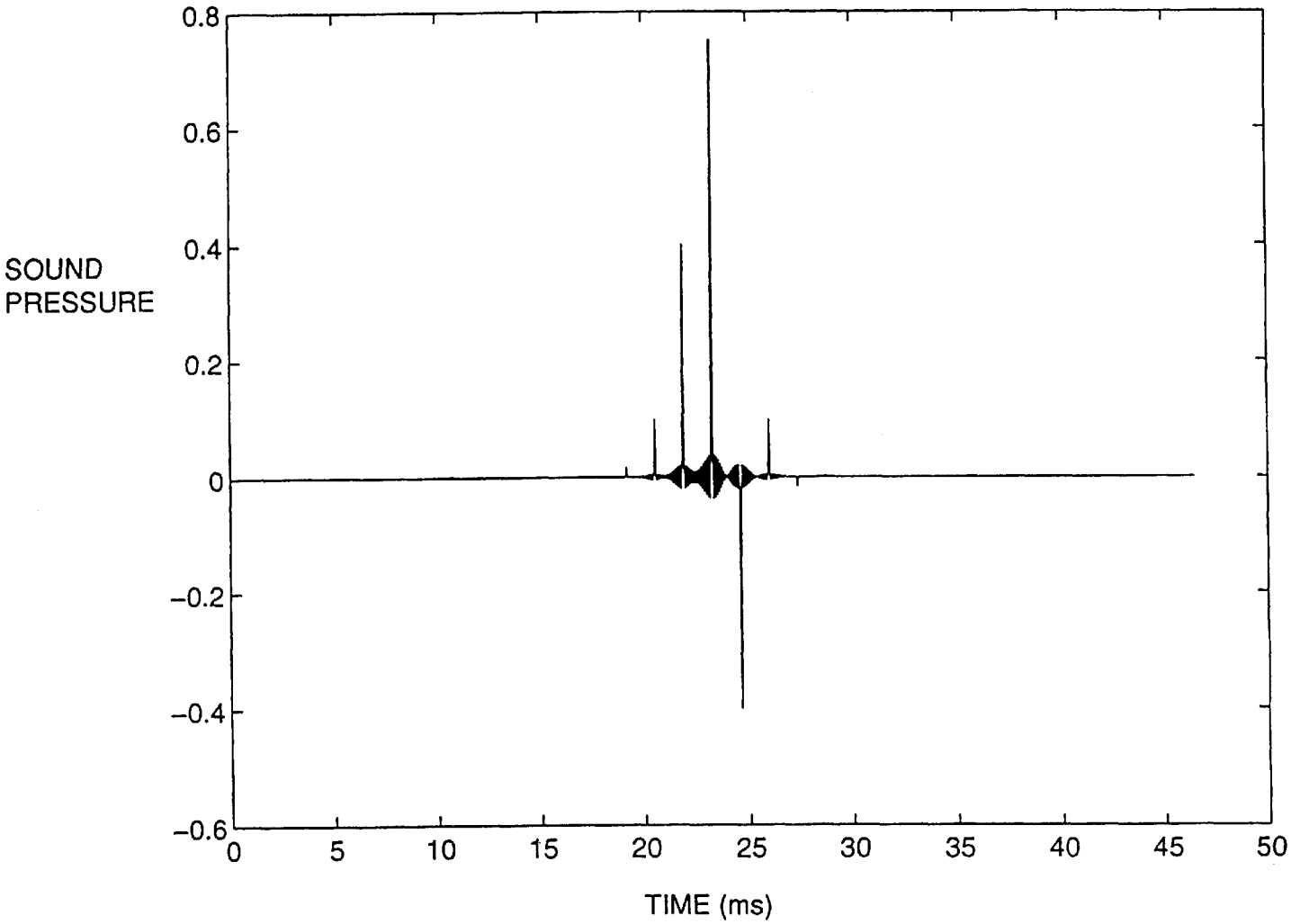
FIG. 1 shows a sound source signal produced using phasing component $\Phi_2(\omega)$.

Now, a speech sound transformation method in terms of a periodic signal transformation method and a sound transformation method according to the present invention will be described in the order of its principle, processing and details included in the processing.

First Embodiment (Principles)

This embodiment positively takes advantage of the periodicity of a speech sound signal and provides a spectral envelope by a direct calculation without the necessity of calculations including iteration and determination of convergence. Phase manipulation is conducted upon re-synthesizing the signal from thus produced spectral envelope, in order to control the cycle and tone with a finer resolution than the sampling frequency, and to have perceptually natural sound.

The following periodic signal (speech sound signal) f(t) is hypothesized. More specifically, $f(t)=f(t+n\tau)$ stands, wherein t represent time, n an arbitrary integer, and τ period of one cycle. If the Fourier transform of the signal is F(ω), F(ω) equals to a pulse train having an interval of 2 π/τ, which is smoothed as follows using an appropriate interpolation function h(λ).

$$S(\omega)=\sqrt{g^{-1}\left(\int_{-\infty}^{\infty}h(\lambda)g(|F(\omega-\lambda)|^2)d\lambda\right)} \tag{1}$$

wherein S(ω) is a smoothed spectrum, g( ) is an appropriate monotonic increasing function, $g^{-1}$ is the inverse function of g( ), and ω and λ are angular frequencies. Although the integral ranges from −∞ to ∞, it may become in the range from −2 π/τ to 2 π/τ using any interpolation function which attains 0 outside the range from −2 π/τ to 2 π/τ for example. Herein, the interpolation function is required to satisfy linear reconstruction condition given below. The linear reconstruction conditions rationally formulate the spectral envelope representing that tone information is "free from the influence of the periodicity of the signal and smoothed".

The linear reconstruction conditions will be detailed. The conditions request that the value smoothed by the interpolation function is constant when adjacent impulses are at the same height. The conditions further request that the value smoothed by the interpolation function becomes linear when the heights of impulses change at a constant rate. The interpolation function h(λ) is a function produced by convoluting a triangular interpolation function $h_2(\omega)$ having a width of 4 π/τ known as Bartlett Window and a function having localized energy such as the one produced by frequency-conversion of a time window function. More specifically, in S(ω), the following equation holds in segment (Δω, (N−2)Δω):

$$a\omega+b=\int_{-\infty}^{\infty}(a\omega+b)h_2(\lambda)\left(\sum_{k=0}^{N}\delta(\omega-\lambda-k\Delta\omega)\right)d\lambda \tag{2}$$

wherein a and b are arbitrary constants, δ( ) is a delta function, and Δω is an angular frequency representation of the interval of the harmonic on the frequency axis corresponding to the cycle τ of the signal. Note that sin(x)/x known as a sampling function would satisfy the linear reconstruction conditions if the pulse train infinitely continues at a constant value or continues to change at a constant rate. An actual signal changing in time however does not continue the same trend, and therefore does not satisfy the linear reconstruction function.

Interaction with the time window will be detailed. If a short term Fourier transform of a signal is required, part of the signal should be cut out using some window function w(t). If a periodic function is cut out using such a window function, the short term Fourier transform will have W(ω), i.e., a Fourier transform of the window function convoluted in a pulse train in the frequency domain. Also in such a case, use of a Bartlett window function satisfying the linear reconstruction conditions as an interpolation function permits the final spectral envelope to satisfy the linear reconstruction conditions.

A method of controlling a fundamental frequency finer than a sampling frequency will be described. The smoothed real number spectrum produced as described above is directly subjected to an inverse Fourier transform to produce a linear phase impulse response s(t) in the temporal domain, which is to be an element. More specifically, using an imaginary number unit $j=\sqrt{-1}$, the following equation holds:

$$s(t) = \frac{1}{\sqrt{2\pi}} \int_{-\infty}^{\infty} S(\omega) e^{j\omega t} d\omega \tag{3}$$

Alternatively, impulse response v(t) of the minimum phase may be produced as follows.

$$c(q) = \frac{1}{\sqrt{2\pi}} \int_{-\infty}^{\infty} \log S(\omega) e^{-j\omega q} d\omega \tag{4}$$

$$g(q) = \begin{cases} 0 & (q < 0) \\ c(0) & (q = 0) \\ 2c(q) & (q > 0) \end{cases} \tag{5}$$

$$V(\omega) = \exp\left( \frac{1}{\sqrt{2\pi}} \int_{0}^{\infty} g(q) e^{j\omega q} dq \right) \tag{6}$$

$$v(t) = \frac{1}{\sqrt{2\pi}} \int_{-\infty}^{\infty} V(\omega) e^{j\omega t} d\omega \tag{7}$$

Transformed speech sound may be produced by adding up linear phase impulse response s(t) or minimum phase impulse response v(t) while moving it by the cycle of interest on the time axis. However, according to the method if the signal is discrete by sampling, the cycle cannot be controlled to be finer than the fundamental period determined based on the sampling frequency. Therefore, taking advantage that time delay is represented as a linear change in phase in the frequency domain, a correction for the cycle finer than the fundamental period is produced upon forming the waveform in order to transform a reconstruction waveform, thereby solving the problem. More specifically, cycle $\tau$ of interest is represented as $(m+r)\Delta T$ using fundamental period $\Delta T$. Herein, m is an integer, r is a real number and $0 \leqq r < 1$ holds. Then, the value of a specific phasing component (hereinafter referred to as phasing component) $\Phi_1(\omega)$ is represented as follows:

$$\Phi_1(\omega) = e^{-j\omega r \Delta T} \tag{8}$$

If a linear phase impulse is used, $S(\omega)$ is phased by phasing component $\Phi_1(\omega)$ to obtain $S_r(\omega)$. More specifically, $\Phi_1(\omega)$ is multiplied by $S(\omega)$ to produce $S_r(\omega)$. Then, $S_r(\omega)$ is used in place of $S(\omega)$ in equation (3), and impulse response $S_r(t)$ of linear phase is produced. The linear phase impulse response $S_r(t)$ is added to the position of the integer amount $m\Delta T$ of the cycle of interest to produce a waveform.

If the minimum phase impulse response is used, $V(\omega)$ is phased by phasing component $\Phi_1(\omega)$ to produce $V_r(\omega)$. More specifically, $\Phi_1(\omega)$ is multiplied by $V(\omega)$ to produce $V_r(\omega)$. Then, $V_r(\omega)$ is used in place of $V(\omega)$ in equation (7) to produce the minimum phase impulse response $v_r(t)$. The minimum phase impulse response $v_r(t)$ is added to the position of the integer amount $m\Delta T$ in the cycle of interest to produce a waveform.

Another example of phasing component $\Phi_2(\omega)$ is represented as follows:

$$\Phi_2(\omega) = \exp\left( j\rho(\omega) \sum_{k \in \Lambda} \alpha_k \cdot \sin(m_k \cdot \xi(\omega)) \right) \tag{9}$$

wherein ext( ) represents an exponential function, and $\xi(\omega)$ is a smooth continuous odd function to map the range $-\pi \leqq \omega \leqq \pi$ to the range $-\pi \leqq \xi \leqq \pi$ and constrained as $\xi(\omega) = \omega$ at both ends of the range $-\pi$ and $\pi$. $\Lambda$ is a set of subscripts, e.g., a finite number of numerals such as 1, 2, 3 and 4. Equation (9) shows that $\Phi_2(\omega)$ is represented as a sum of a plurality of different trigonometric functions on angular frequency $\omega$ expanded/contracted in a non linear form by $\xi(\omega)$, with each trigonometric function being weighted by a factor $\alpha_k$. Note that k in equation (9) is one number taken from $\Lambda$, and $m_k$ in the equation represents parameter. $\rho(\omega)$ represents a function indicating a weight. An example of continuous function $\xi(\omega)$ with parameter $\beta$ is given as follows, wherein sgn ( ) is a function which becomes 1 if the inside of ( ) is 0 or positive and −1 for negative.

$$\xi(\omega) = \pi \cdot \mathrm{sgn}(\omega) \left| \frac{\omega}{\pi} \right|^{\beta} \tag{10}$$

Taking advantage that the frequency differential of phase rotation on the frequency axis corresponds to group delay, using the integral of a random number the average of which is 0 as a phase component, the distribution of group delay may be controlled by the random number. The control of the phase of a high frequency component greatly contributes to improvement of the natural quality of synthesized speech sounds, for example, for creating voice sound mixed with the sound of breathing. More specifically, speech sounds are synthesized by phasing with phasing component $\Phi_3(\omega)$, which is produced as follows.

As a first step, a random number is generated, followed by a second step of convoluting the random number generated in the first step and a band limiting function on the frequency axis. As a result, a band-limited random number is produced. As a third step, which frequency region tolerates how much fluctuation of group delay is designed. More specifically, which frequency region tolerates how much fluctuation of delay time is designed. Actually a target value of fluctuation of delay time is designed. The band-limited random number (produced in the second step) is multiplied by the target value of the fluctuation of delay time to produce a group delay characteristic. As a fourth step, the integral of the group delay characteristic by the frequency is produced to obtain a phase characteristic. As a fifth step, the phase characteristic is multiplied by imaginary number unit ($j=\sqrt{-1}$) to obtain the exponent of an exponential function, and phasing component $\Phi_3(\omega)$ results.

The control of phase using a trigonometric function (the control of phase using $\Phi_2(\omega)$) and the control of phase using the random number (the control of phase using $\Phi_3(\omega)$) are represented in the terms of frequency regions, and therefore $\Phi_2(\omega)$ is multiplied by $\Phi_3(\omega)$ to produce a phasing component having the natures of both. More specifically, a sound source having a noise-like fluctuation derived from the fluctuation of a turbulent flow or the vibration of vocal cords in the vicinity of discrete pulses corresponding to the event of opening/closing of glottis can be produced. Meanwhile, $\Phi_1(\omega)$, $\Phi_2(\omega)$ and $\Phi_3(\omega)$ may be multiplied to produce a phasing component, $\Phi_1(\omega)$ may be multiplied by $\Phi_2(\omega)$ to produce a phasing component, or $\Phi_1(\omega)$ may be multiplied by $\Phi_3(\omega)$ to produce a phasing component. Herein, the method of phasing using phasing components $\Phi_2(\omega)$, $\Phi_3(\omega)$, $\Phi_1(\omega)\cdot\Phi_2(\omega)\cdot\Phi_3(\omega)$, $\Phi_1(\omega)\cdot\Phi_2(\omega)$, $\Phi_1(\omega)\cdot\Phi_3(\omega)$ and $\Phi_1(\omega)\cdot\Phi_3(\omega)$ is the same as the method of phasing using $\Phi_1(\omega)$.

Figure 2:
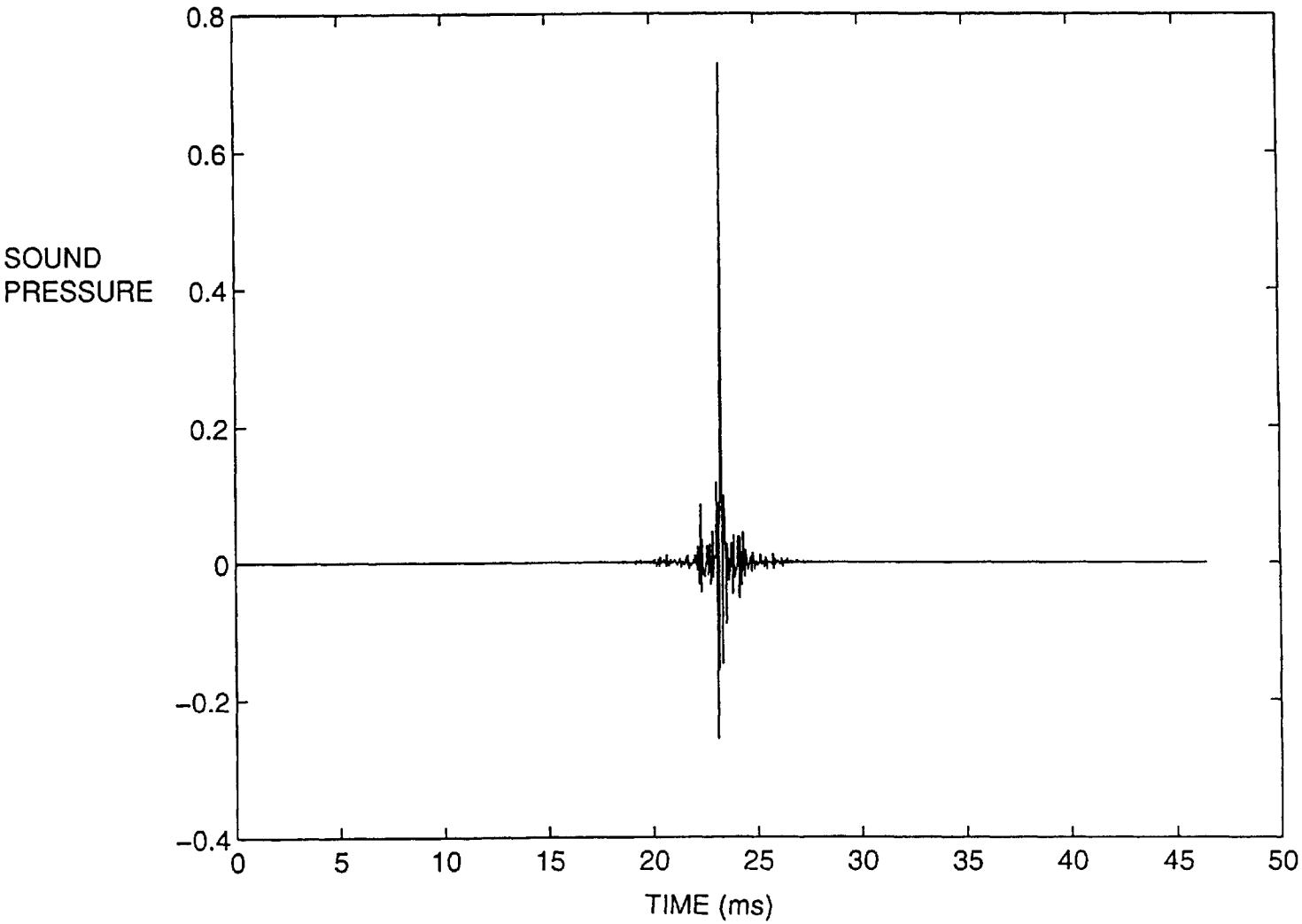
FIG. 2 shows a sound source signal produced using phasing component $\Phi_3(\omega)$.
Figure 3:
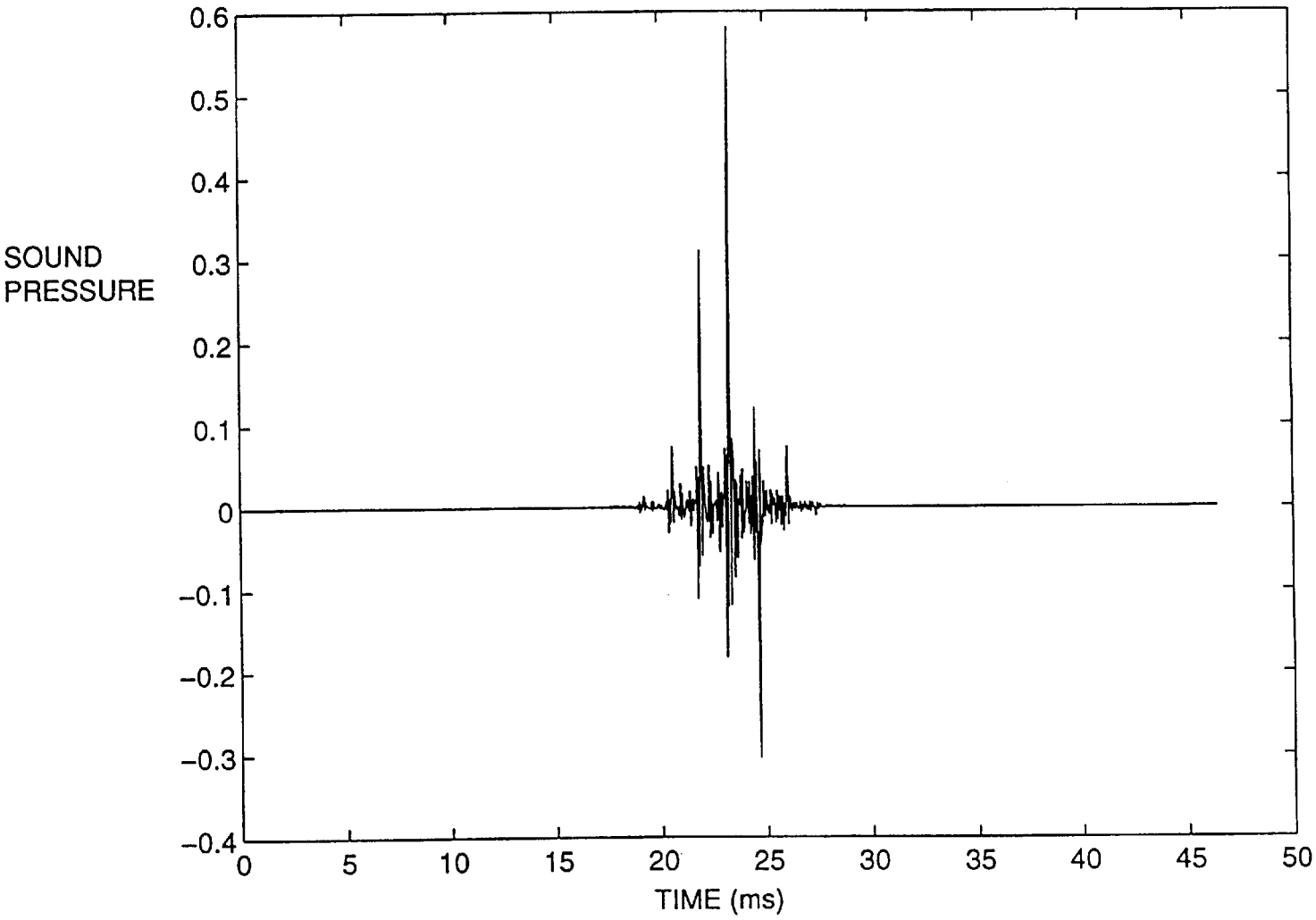
FIG. 3 shows a sound source signal produced using a phasing component created by multiplying phasing component $\Phi_2(\omega)$ and phasing component $\Phi_3(\omega)$.

FIG. 1 shows a sound source signal obtained using phasing component $\Phi_2(\omega)$. Referring to FIG. 1, the abscissa represents time and the ordinate represents sound pressure. Herein, equation (10) is used as continuous function $\xi(\omega)$ constituting phasing component $\Phi_2(\omega)$. A weighting function having a constant value $\rho(\omega)=1$ is selected. $\Lambda$ is formed of a single number, k=1, $m_1=30$, $\alpha_1=0.3$ and $\beta=1$. FIG. 2 shows a sound source signal obtained using phasing component $\Phi_3(\omega)$. FIG. 3 shows a sound source signal obtained using phasing component $\Phi_2(\omega)\cdot\Phi_3(\omega)$. Referring to FIGS. 2 and 3, the abscissa represents time, and the ordinate represents sound pressure. Referring to FIGS. 1 to 3, it is observed that the sound signal has its energy distributed in time as alternating impulses. Herein, the sound source signal is in the form of a function in time of the phasing component. More specifically, the sound source signal is produced by the inverse Fourier transform of the phasing component and represented as a function in time.

(Processings)

The speech sound transformation method according to the first embodiment proceeds as follows. It is provided that a speech sound signal to be analyzed has been digitized by some means. As a first processing, extraction of the fundamental frequency (fundamental period) of a voice sound will be detailed. In the speech sound transformation method according to the first embodiment, the periodicity of the speech sound signal to be analyzed is positively utilized. The periodicity information is used to determine the size of an interpolation function in equations (1) and (2). In the first processing, parts of the speech sound signal are selected one after another, and a fundamental frequency (fundamental period) in each part is extracted. More specifically, the fundamental frequency (fundamental period) is extracted with a resolution finer than the fundamental period of the digitized speech sound signal. As to a portion including non-periodic signal portions, the fact is extracted in some form. Thus precisely extracting the fundamental frequency in the first processing will be critical in a fifth processing which will be described later. Such extraction of the fundamental frequency (fundamental period) is conducted by a general existing method. If necessary, the fundamental frequency may be determined manually by visually inspecting the waveform of speech sound.

A second processing for adaptation of an interpolation function using the information of the fundamental frequency will be detailed. In the second processing, using a one-dimensional interpolation function satisfying the conditions expressed in equation (2), the spectrum of a speech sound signal and the interpolation function are convoluted in the direction of frequency according to equation (1) to calculate a smoothed spectrum. Thus, the influence of the periodicity in the direction of the frequency is eliminated.

A third processing for transforming speech sound parameters will be described. In the third processing, to change the nature of the voice sound of a speaker (for example, to change a female voice to a male voice), the frequency axis in obtained speech sound parameters (the smoothed spectrum and the fine fundamental frequency information) is compressed, or the fine fundamental frequency is multiplied by an appropriate factor in order to change the pitch of the voice. Thus changing the speech sound parameters to meet a particular object is transformation of speech sound parameters. A variety of speech sounds may be created by adding a manipulation to the speech sound parameters (smoothed spectrum and fine fundamental frequency information).

Now, a fourth processing for synthesizing speech sounds using the speech sound parameters resulting from the transformation will be described. In the fourth processing, a sound source waveform is created for every cycle determined by the fine fundamental frequency using equation (3) based on the smoothed spectrum, and thus created sound source waveforms are added up while shifting the time axis, in order to create a speech sound resulting from a transformation, in other words, speech sounds are synthesized. The time axis cannot be shifted at a precision finer than the fundamental period determined based on the sampling frequency upon digitizing the signal. Based on the fractional amount of the accumulated fundamental periods in terms of the sampling period, value $\Phi_1(\omega)$ calculated using equation (8) is multiplied by $S(\omega)$ in equation (1), which is then used to produce a sound source waveform represented by s(t) using equation (3), so that the control of the fundamental frequency with a finer resolution than that determined by the fundamental period is enabled.

A sound source waveform is produced for every cycle determined based on the fine fundamental frequency using equations (4), (5), (6), and (7) according to the smoothed spectrum, and thus produced sound source waveforms may be added up while shifting the time axis, in order to transform a speech sound. In that case as to the remainder (fractional parts) produced by dividing the accumulated fundamental cycles by the fundamental period, value $\Phi_1(\omega)$ calculated using equation (8) is multiplied by $V(\omega)$ in equation (6) to produce a sound source waveform represented by v(t) using equation (7) so that the control of the fundamental frequency is enabled at a precision finer than the resolution determined based on the fundamental period. Herein, $\Phi_1(\omega)$ is used as a phasing component for the multiplication by $S(\omega)$ or $V((\omega)$, $\Phi_2(\omega)$, $\Phi_3(\omega)$, $\Phi_1(\omega)\cdot\Phi_2(\omega)\cdot\Phi_3(\omega)$, $\Phi_1(\omega)\cdot\Phi_2(\omega)$, $\Phi_1(\omega)\cdot\Phi_3(\omega)$ or $\Phi_2(\omega)\cdot\Phi_3(\omega)$ may be used instead.

The fourth processing can be utilized by itself. More specifically, the smoothed spectrum is only a two-dimensional shaded image, and the fine fundamental frequency is simply a one-dimensional curve having a width identical to the transverse width of the image. Therefore, using the fourth processing, such an image and a curve may be transformed into a sound without losing their information. More specifically, a sound may be created with such an image and a curve without inputting a speech sound signal.

(Details of Processings)

Figure 4:
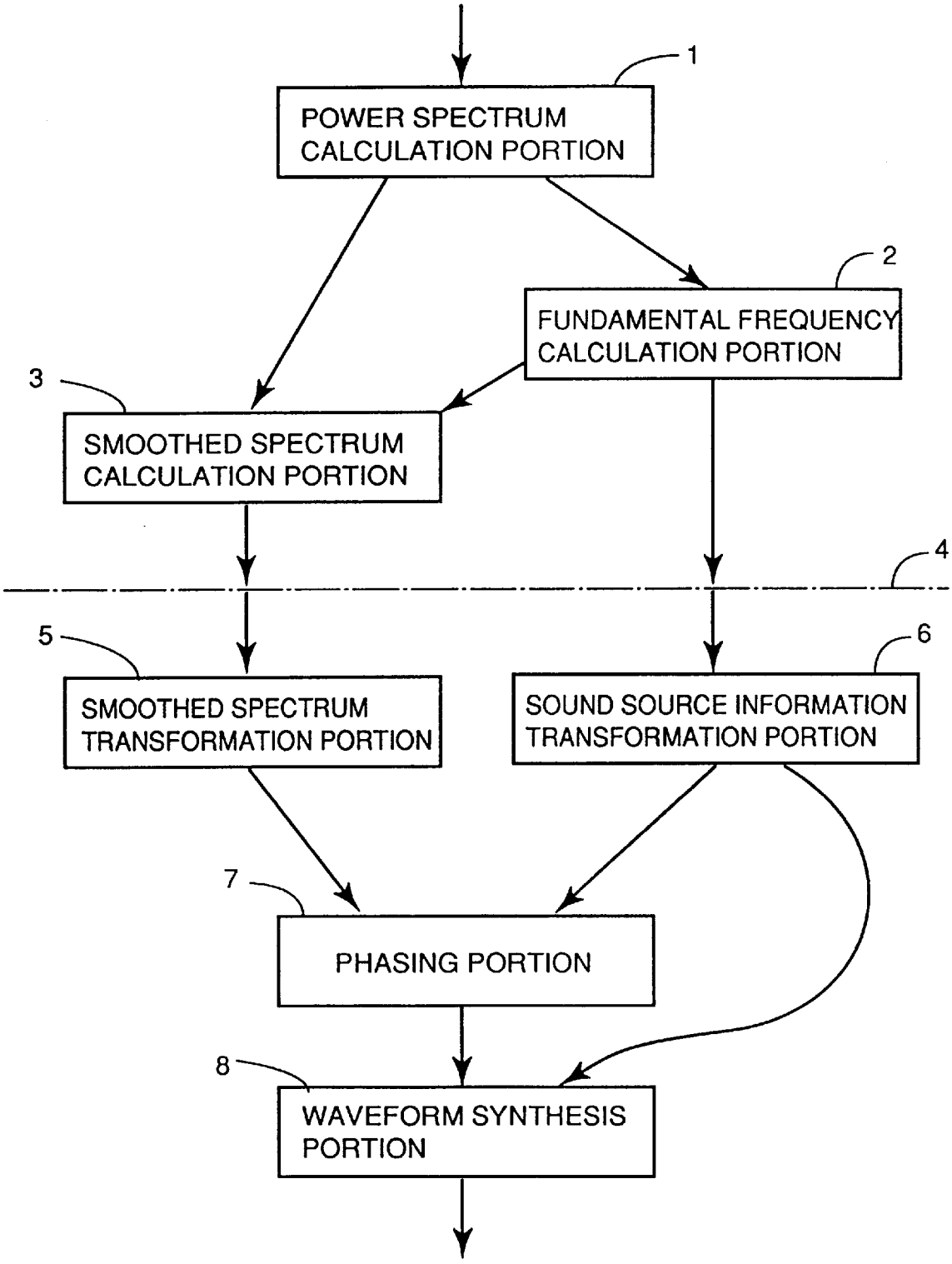
FIG. 4 is a block diagram schematically showing a speech sound transformation device for implementing a speech sound transformation method according to a first embodiment of the invention.

FIG. 4 is a block diagram schematically showing a speech sound transformation device for implementing the speech sound transformation method according to the first embodiment of the invention. Referring to FIG. 4, the speech sound transformation device includes a power spectrum calculation portion 1, a fundamental frequency calculation portion 2, a smoothed spectrum calculation portion 3, an interface portion 4, a smoothed spectrum transformation portion 5, a sound source information transformation portion 6, a phasing portion 7, and a waveform synthesis portion 8. An example of transforming a speech sound sampled at 8 kHz for 16 bits using the speech sound transformation device shown in FIG. 4 will be described.

Power spectrum calculation portion 1 calculates the power spectrum of a speech sound waveform by means of FFT (Fast Fourier Transform), using a 30 ms Hanning window. A harmonic structure due to the periodicity of the speech sound is observed in the power spectrum.

Figure 5:
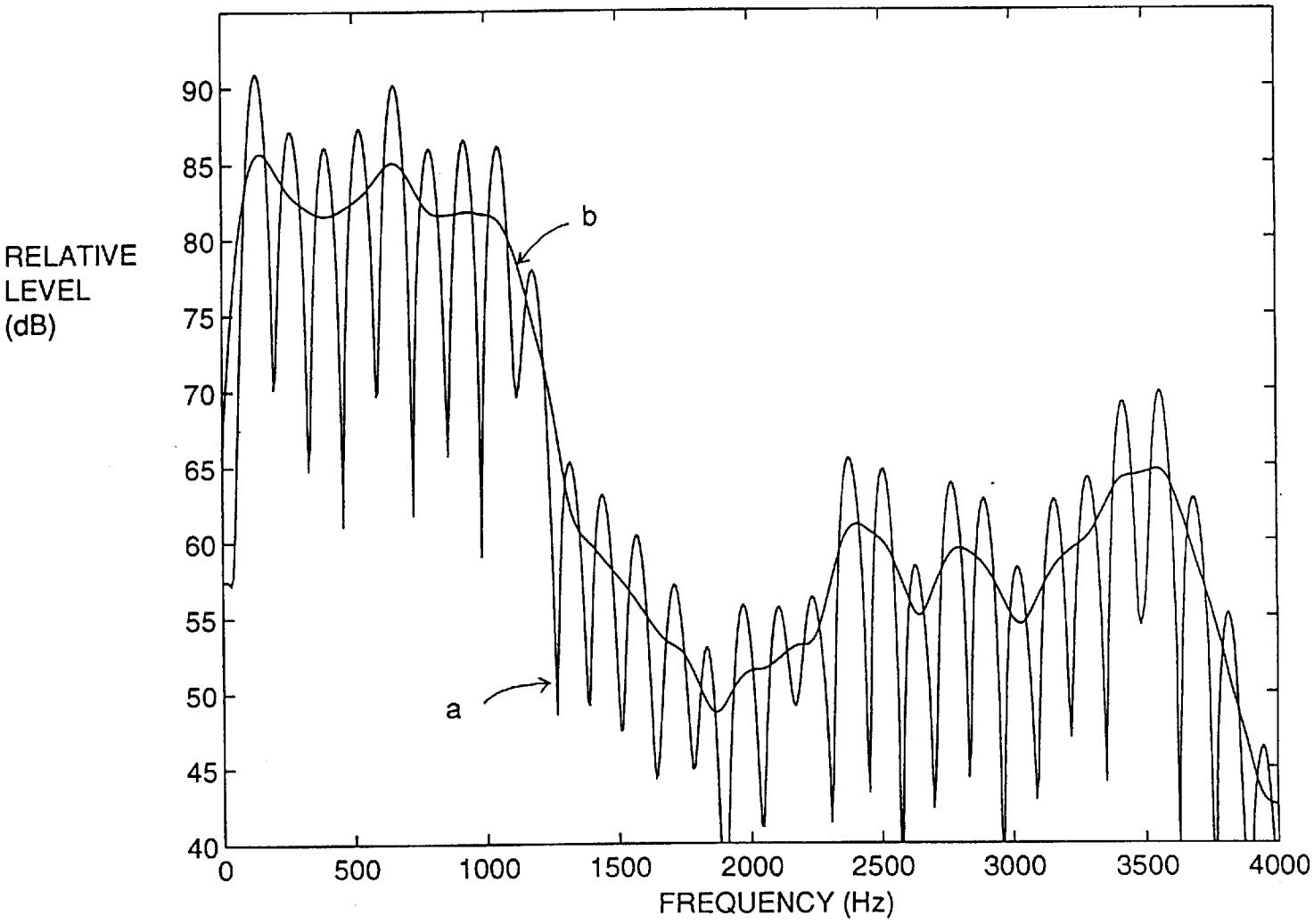
FIG. 5 is a graph showing a power spectrum produced at a power spectrum calculation portion in FIG. 4 and a smoothed spectrum produced at a smoothed spectrum calculation portion.

FIG. 5 shows an example of power spectrum produced by power spectrum calculation portion 1 and an example of smoothed spectrum produced by smoothed spectrum calculation portion 3 shown in FIG. 4. The abscissa represents frequency, and the ordinate represents intensity in logarithmic (decibel) representation. Referring to FIG. 5, the curve denoted by arrow a is the power spectrum produced by power spectrum calculation portion 1.

Referring back to FIG. 4, the fundamental frequency $f_0$ of the speech sound is produced at fundamental frequency calculation portion 2 based on the cycle of the harmonic structure of the power spectrum shown in FIG. 5. Power spectrum calculation portion 1 and fundamental frequency calculation portion 2 execute the above-described first processing (extraction of the fundamental frequency of a speech sound). At smoothed spectrum calculation portion 3, based on fundamental frequency $f_0$ calculated at fundamental frequency calculation portion 2, a function in the form of a triangle with a width of $2f_0$ is for example selected as an interpolation function for smoothing. Using the interpolation function, a cyclic convolution is executed on the frequency axis to produce a smoothed spectrum.

Referring back to FIG. 5, the curve denoted by arrow b is a smoothed spectrum. Herein, a function for obtaining a square root is used as a monotonic increasing function g( ). In order to approximate to human perception, a function for raising the power to the 6/10-th power may be used. Smoothed spectrum calculation portion 3 executes the above-described second processing (adaptation of an interpolation function taking advantage of the information of a fundamental frequency). The smoothed spectrum produced at smoothed spectrum calculation portion 3 is delivered to smoothed spectrum transformation portion 5, and the sound source information (fine fundamental frequency information) obtained at fundamental frequency calculation portion 2 is delivered to sound source information transformation portion 6. The smoothed spectrum and sound source information may be stored for later use. Interface portion 5 functions as an interface portion between the stage of calculating the smoothed spectrum and sound source information and the stage of transformation/synthesis.

Figure 6:
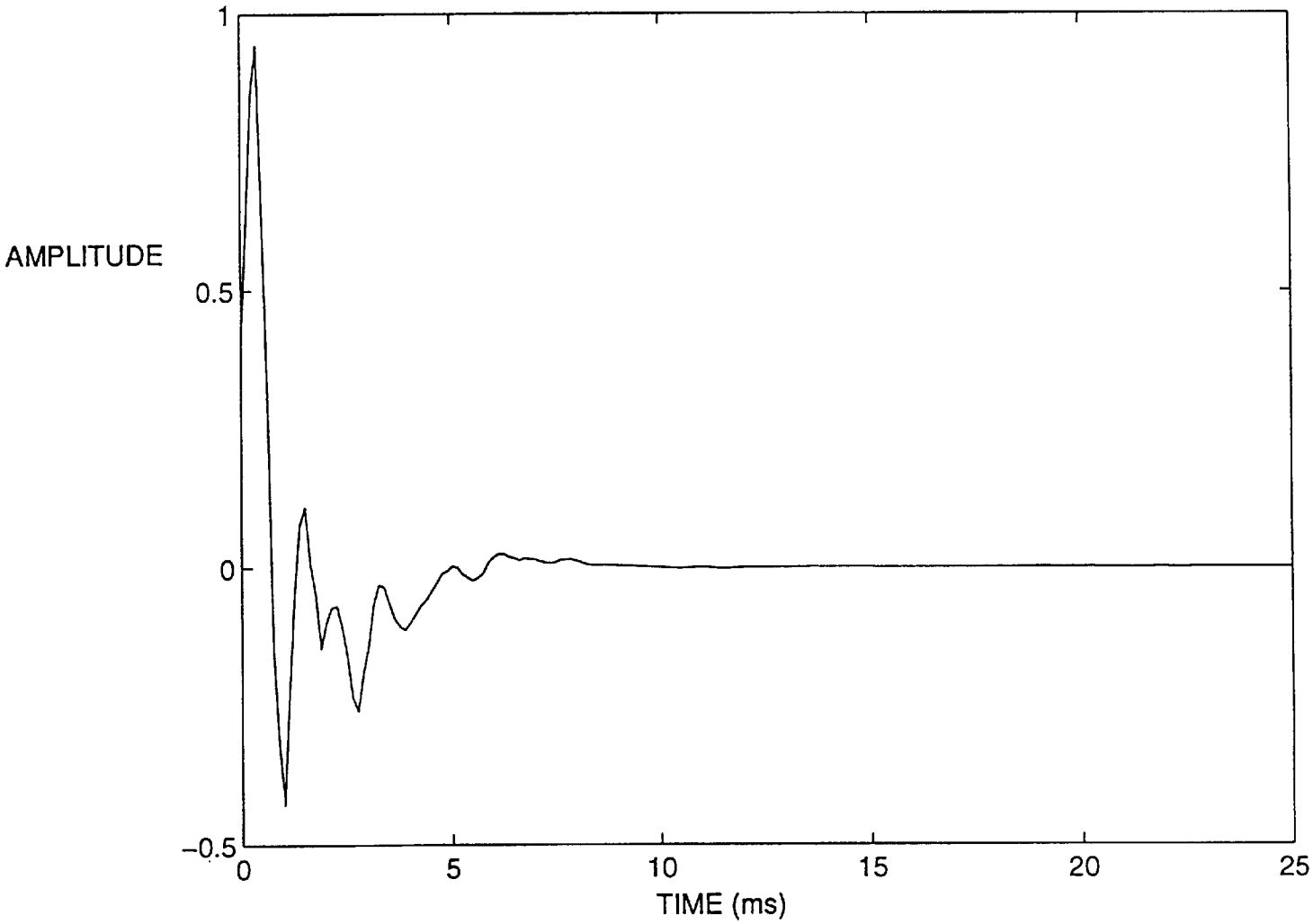
FIG. 6 is a graph showing minimum phase impulse response v(t)
Figure 7:
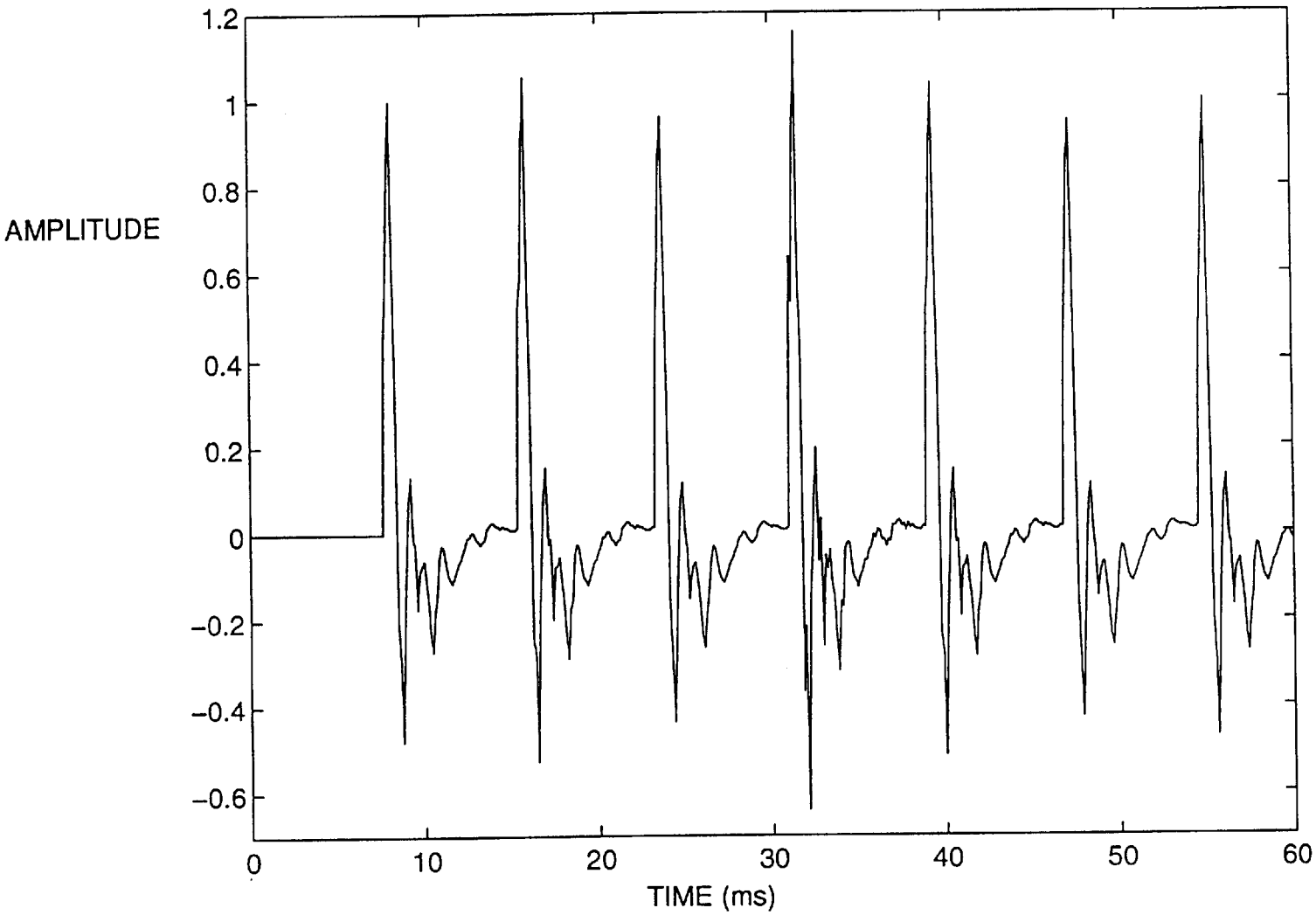
FIG. 7 is a graph showing a signal resulting from transformation and synthesis.

At smoothed spectrum transformation portion 5, smoothed spectrum $S(\omega)$ is transformed into $V(\omega)$ in order to create minimum phase impulse response v(t). If the tone is to be manipulated, the smoothed spectrum is deformed by manipulation as desired, and the deformed smoothed spectrum $Sm(\omega)$ results. Alternatively, the deformed smoothed spectrum $Sm(\omega)$ is transformed into $V(\omega)$ using equations (4) to (6). More specifically, instead of $S(\omega)$ in equation (4), $V(\omega)$ is calculated using $Sm(\omega)$. In the following description, the smoothed spectrum as well as the deformed smoothed spectrum $Sm(\omega)$ will be represented as "$S(\omega)$". At sound source information transformation portion 6, in parallel with the transformation at smoothed spectrum transformation portion 5, the sound source information is transformed to meet a particular purpose. The processings at smoothed spectrum transformation portion 5 and sound source information transformation portion 6 correspond to the above third processing (transformation of speech sound parameters). At phasing portion 7, using the spectrum information and sound source information resulting from the transformation at smoothed spectrum transformation portion 5 and sound source information transformation portion 6, a processing for manipulating the fundamental period with a finer resolution than the fundamental period is executed. More specifically, the temporal position to place a waveform of interest is calculated using fundamental period $\Delta T$ as a unit, a result is separated into an integer portion and a real number portion, and phasing component $\Phi_1(\omega)$ is produced using the real number portion. Then, the phase of $S(\omega)$ or $V(\omega)$ is adjusted. At waveform synthesis portion 8, the smoothed spectrum phased at phasing portion 7 and the sound source information transformed at sound source information transformation portion 6 are used to produce a synthesized waveform. Phasing portion 7 and waveform synthesis portion 8 execute the fourth processing (speech sound synthesis by the transformed speech sound parameters) described above. FIG. 6 shows an example of minimum phase impulse response v(t) produced by the inverse Fourier transform of $V(\omega)$. Referring to FIG. 6, the abscissa represents time and the ordinate represents sound pressure (amplitude). FIG. 7 shows a signal waveform resulting from synthesis by transforming a sound source using $V(\omega)$. Referring to FIG. 7, the abscissa represents time, and the ordinate represents sound pressure (amplitude). Referring to FIG. 7, since the fundamental frequency is controlled finer than the fundamental period, the form of repeated waveforms or the heights of their peaks are slightly different.

As in the foregoing, according to the speech sound transformation method of the first embodiment, taking advantage that the peaks of the spectrum of a periodic signal appear at equal intervals on the frequency axis, an interpolation function for preserving linearity as the peak values of the spectrum at equal intervals change linearly and the spectrum of the periodic signal are convoluted to produce a smoothed spectrum. More specifically, a spectrum less influenced by the periodicity may result. As a result, according to the speech sound transformation method of the first embodiment, a speech sound may be transformed in pitch, speed and frequency band in the range up to 500% which has never been achieved, without severe degradation.

In addition, according to the speech transformation method of the first embodiment, a smoothed spectrum is extracted under a single rational condition that only the periodicity of a signal is used to reconstruct a linear portion as a linear portion, and therefore a sound emitted from any sound source may be transformed into a sound of high quality, as opposed to methods based on the model of a spectrum.

Also according to the speech transformation method of the first embodiment, since interference to the form of spectrum by a periodic component in the analysis of a speech sound or the like may be greatly reduced, a smoothed spectrum is useful for diagnosis of a speech sound.

Furthermore, according to the speech sound transformation method of the first embodiment, since interference to the form of a spectrum by a periodic component in the analysis of a speech sound may be greatly reduced, a smoothed spectrum may greatly contribute to improvement to the precision of producing a standard pattern in speech sound recognition/speaker recognition.

In addition, according to the speech sound transformation method of the first embodiment, in an electronic musical instrument, a smoothed spectrum information and sound source information (information on the periodicity or intensity of a speech sound) may be separately stored rather than storing a sampled signal itself, musical expression which has not been demonstrated before may be produced by fine control of cycle or control of a tone using a phasing component.

In addition, according to the speech sound transformation method of the first embodiment, since an arbitrary faded image may be synthesized into a sound, applications to artistic expression, information presentation to the visually handicapped, and a new user interface by presentation of data in computer in acoustic sounds are enabled. Such applications would fundamentally change the study of speech sounds as well as bring impact to the field of sounds as much as the computer graphics to the field of images.

Furthermore, the speech sound transformation method according to the first embodiment may enable the following. For example, considering that the size of the phonatory organ of a cat is about ¼ the size of human phonatory organ, if the vocal sound of a cat is transformed into the one as if coming from the organ four times the actual size, or human vocal sound is transformed into the one as if coming from the organ ¼ the actual size according to the speech sound transformation method of the first embodiment, somewhat equal-in-size communication which has never been possible due to physical difference in size might be possible between the animals of different species.

Second Embodiment

The nature of a general spectrogram (spectrum in time/frequency representation) will be stated. First, a spectrogram with a high time resolution will be described. At an arbitrary frequency, the change of spectrogram in a temporal direction is observed. In this case, in the temporal representation of the spectrogram, there is left an influence by the periodicity of a speech sound. Meanwhile, with the time being fixed, the change of the spectrogram in the direction of frequency is observed. In this case, it is observed that the change of the frequency representation of the spectrogram is ruined as compared to the change of frequency representation of the original spectrogram. Now, the nature of a spectrogram with a high frequency resolution will be described. With the frequency being fixed, the change of the spectrogram in time is observed. In this case, it is observed that the change of the temporal representation of the spectrogram is ruined as compared to the change of the temporal representation of the original spectrogram. Meanwhile, with the time being fixed, the change of the spectrogram in the frequency direction is observed. In this case, the influence of the periodicity is left in the frequency representation of the spectrogram. If the frequency resolution is increased, the time resolution is necessarily lowered, while if the time resolution is increased, the frequency resolution is necessarily lowered.

According to a conventional speech sound transformation method, a spectrum to be analyzed is greatly influenced by the periodicity, and therefore there is little flexibility in manipulating a speech sound. Therefore, in the speech sound transformation method according to the first embodiment, a spectrum smoothed in the frequency direction is obtained in order to reduce the influence of the periodicity in the frequency direction of a spectrum to be analyzed. In this case, in order to reduce the influence of the periodicity in the temporal direction, the frequency resolution is increased (the time resolution is lowered), and the spectrum is analyzed. If the frequency resolution is increased, fine changes of a spectrum in the temporal direction are ruined. A speech sound transformation method according to a second embodiment is directed to a solution to such a problem.

(Principles)

The principles of the speech sound transformation method according to the second embodiment are identical to those of the speech sound transformation method according to the first embodiment, with an essential difference being that according to the first embodiment, it is requested that interpolation function $h(\lambda)$ in equation (1) satisfies the linear reconstruction condition, but according to the second embodiment, interpolation function $h_t(\lambda, u)$ in equation (11) is requested to satisfy a bilinear surface reconstruction condition in addition to the linear reconstruction condition.

$$S_2(\omega, t) = \sqrt{g^{-1}\left(\int_{-\infty}^{\infty}\int_{-\infty}^{\infty} h_t(\lambda, u) g(|F_2(\omega-\lambda, t-u)|^2) d\lambda du\right)} \quad (11)$$

wherein $\lambda$ represents an integral variable corresponding to a frequency, and u an integral variable corresponding to time. $S_2(\omega, t)$ is a smoothed spectrogram corresponding to $S(\omega)$ in equation (1), while $F_2(\omega, t)$ is a spectrogram corresponding to $F(\omega)$ in equation (1). The bilinear surface reconstruction condition will be described. The linear reconstruction condition in the first embodiment is on the frequency axis. The periodicity effect of a signal is also recognized in the temporal direction. Therefore, in the case of a periodic signal, information on grid points for every fundamental frequency in the frequency direction and for every fundamental period in the temporal direction may be obtained through analysis of the signal. If the one-dimensional condition described in the first embodiment is extended into a two-dimensional condition, interpolation function $h_t(\lambda, u)$ is rationally requested to preserve a surface represented in the following bilinear formula:

$$C_\omega \omega + C_t t + C_0 = 0 \quad (12)$$

wherein $C_\omega$, $C_t$, and $C_0$ are parameters representing the bilinear surface, and may take an arbitrary constant value. Such bilinear surface reconstruction conditions can be satisfied using as interpolation function $h_t(\lambda, u)$ what is produced by two-dimensional convolution of a triangular interpolation function having a width of $4\pi/\tau$ in the frequency direction and a triangular interpolation function having a width of $2\tau$ in the temporal direction.

(Processings)

A first processing, a third processing and a fourth processing in the speech sound transformation method according to the second embodiment are identical to the first, third and fourth processings according to the first embodiment, respectively. In the speech sound transformation method according to the second embodiment, between the first processing and second processing in the speech sound transformation method of the first embodiment, a special processing is executed. The special processing in the speech sound transformation method according to the second embodiment is hereinafter referred to as "the intermediate processing". In the second processing the speech sound transformation method according to the second embodiment is different from the second processing according to the first embodiment. In the third processing in the speech sound transformation method of the second embodiment, the third processing according to the first embodiment as well as other processings may be executed.

The intermediate processing for frequency analysis adapted to the fundamental period will be described. In the intermediate processing, using information on the fundamental period of a speech sound signal, such a time window is designed that the ratio of the frequency resolution of the time window to the fundamental frequency is equal to the ratio of the time resolution of the time window to the fundamental period for adaptive spectral analysis. In the portion without periodicity such as noise, a perceptual time resolution in the order of several ms is set for the length of time window for analysis. In order to maximize the effect of the method according to the second embodiment, in the intermediate processing spectral analysis should be conducted at a frame update period finer than the fundamental period of the signal (such as ¼ the fundamental period or finer), using the time window satisfying the above condition. Note that for a time window having a fixed length, if several fundamental periods are included in the time window, reconstruction to a great extent is also possible in the second processing which will be described later.

The second processing of the speech sound transformation method according to the second embodiment will be detailed. In the second processing, the time-frequency representation of a spectrum produced in the processing until the intermediate processing (for example the intensity of the spectrum represented in a plane with the abscissa being time and the ordinate being frequency, or voiceprint), in other words a spectrogram is used. In the second processing, an interpolation function satisfying the conditions according to equations (2) and (12) is produced based on the information on the fundamental frequency. The interpolation function and spectrogram are convoluted in the two-dimensional direction of time and frequency. A smoothed spectrogram removed of the influence of periodicity is thus obtained. In addition, a smoothed spectrogram may be obtained in which information on grid points on time-frequency plane which may be provided with a periodic signal is most efficiently extracted in a natural form. The third processing in the speech sound transformation method according to the second embodiment includes the third processing according to the first embodiment. In the third processing according to the second embodiment, time axis of produced speech sound parameters (smoothed spectrogram and fine fundamental frequency information) are expanded/compressed in order to increase the speech rate. Note that the processing proceeds sequentially from the first processing, the intermediate processing, the second processing, the third processing and the fourth processing.

(Details of Processings)

Figure 8:
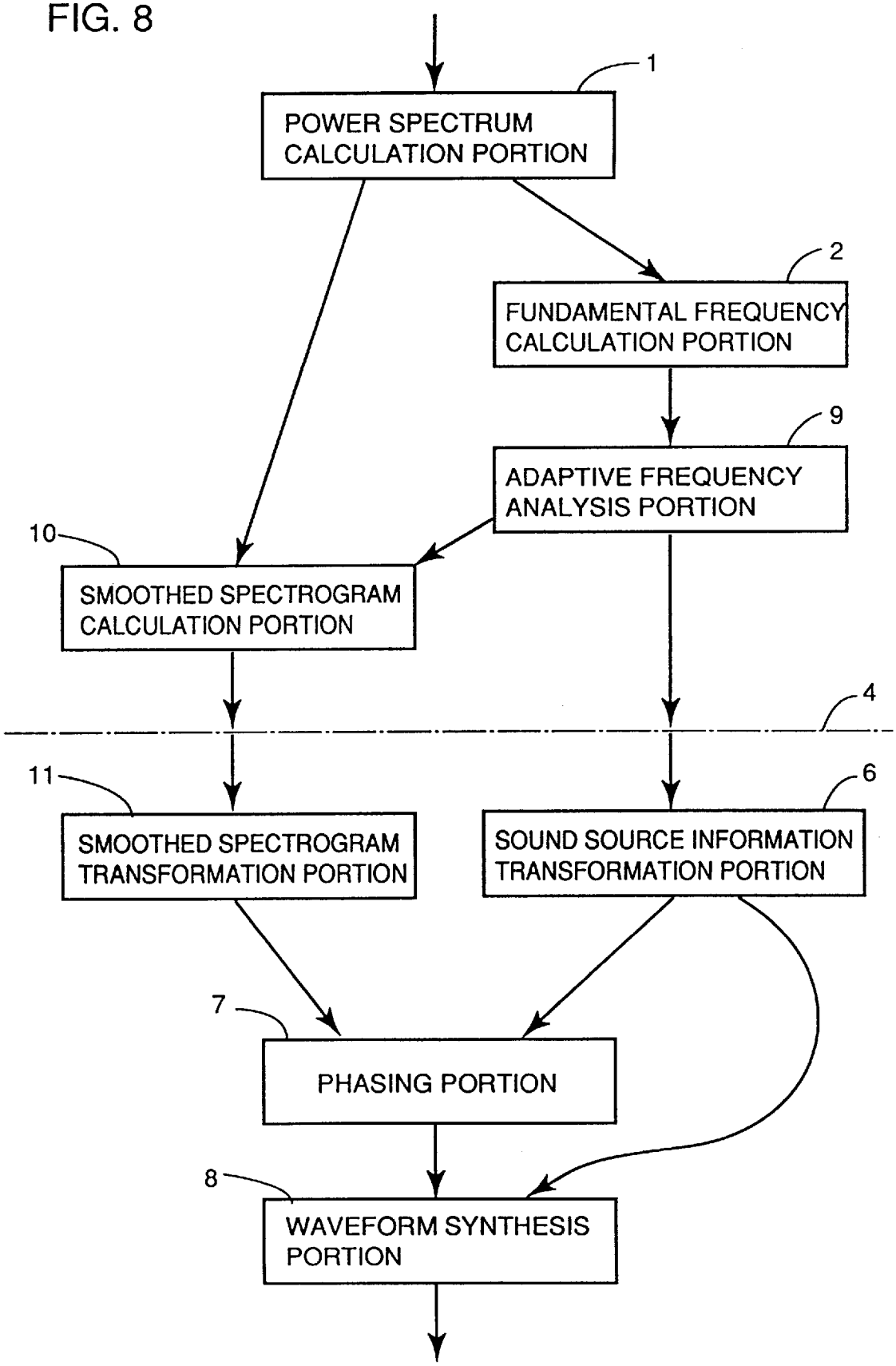
FIG. 8 is a block diagram schematically showing a speech sound transformation device for implementing a speech sound transformation method according to a second embodiment of the invention.

FIG. 8 is a speech sound transformation device for implementing the speech sound transformation method according to the second embodiment. Referring to FIG. 8, the speech sound transformation device includes a power spectrum calculation portion 1, a fundamental frequency calculation portion 2, an adaptive frequency analysis portion 9, a smoothed spectrogram calculation portion 10, an interface portion 4, a smoothed spectrogram transformation portion 11, a sound source information transformation portion 6, a phasing portion 7 and a waveform synthesis portion 8. The same portions as shown in FIG. 4 are denoted with the same reference numerals and characters with description being omitted.

Power spectrum calculation portion 1 digitizes a speech sound signal. In the digitized speech sound signal, a set of a number of pieces of data corresponding to 30 ms is multiplied by a time window and transformed into a short term spectrum by means of FFT (Fast Fourier Transform) or the like and the result is delivered to fundamental frequency calculation portion 2 as an absolute value spectrum. Fundamental frequency calculation portion 2 convolutes a smoothed window in a frequency region having a width of 600 Hz with the absolute value spectrum delivered from power spectrum calculation portion 1 to produce a smoothed spectrum. The absolute spectrum delivered from power spectrum calculation portion 1 is divided by the smoothed spectrum for every corresponding frequency, in order to produce a flattened absolute value spectrum. Stated differently, (absolute value spectrum provided from power spectrum calculation portion 1)/(smoothed spectrum produced at fundamental frequency calculation portion 2)= (flattened absolute value spectrum).

The portion of the flattened absolute value spectrum at 1000 Hz or lower is multiplied by a low-path filter characteristic having a form of a Gaussian distribution, and the result is raised to the second power followed by an inverse Fourier transform to produce a normalized and smoothed autocorrelation function. A normalized correlation function produced by normalizing the correlation function by the autocorrelation function of the time window used at the power spectrum calculation portion 1 is searched for its maximum value, in order to produce the initial estimated value of the fundamental period of the speech sound. Then, a parabolic curve is fit along the values of three points including the maximum value of the normalized correlation function and the points before and after, in order to estimate the fundamental frequency finer than the sampling period for digitizing the speech sound signal. If the portion is not determined to be a periodic speech sound portion because the power of the absolute value spectrum delivered from power spectrum calculation portion 1 is not enough or the maximum value of the normalized correlation function is small, the value of the fundamental frequency is set to 0 for recording the fact. Power spectrum calculation portion 1 and fundamental frequency calculation portion 2 execute the first processing (extraction of the fundamental frequency of the speech sound). The first processing as described above is repeatedly and continuously executed for every 1 ms.

Note that in the fundamental frequency calculation portion 2, as described in conjunction with the first embodiment, a general existing method or a manual operation of visually inspecting the waveforms of a speech sound may be employed.

Adaptive frequency analysis portion 9 designs such a time window that the ratio of the frequency resolution of the time window and the fundamental frequency is equal to the ratio of the time resolution of the time window and the fundamental period based on the value of the fundamental frequency calculated at fundamental frequency calculation portion 2. More specifically, after determining the form of the function of the time window, the fact that the product of the time resolution and the frequency resolution becomes a constant value is utilized. The size of the time window is updated using the fundamental frequency produced at fundamental frequency calculation portion 2 for every analysis of a spectrum. The spectrum is obtained using thus designed time window. Adaptive frequency analysis portion 9 executes the intermediate processing (frequency analysis adapted to the fundamental period). Smoothed spectrogram calculation portion 10 obtains a triangular interpolation function having a frequency width twice that of the fundamental frequency of the signal. The interpolation function and the spectrum produced at adaptive frequency analysis portion 3 are convoluted in the frequency direction. Then, using a triangular interpolation function having a time length twice that of the fundamental period, the spectrum which has been interpolated in the frequency direction is interpolated in the temporal direction, in order to obtain a smoothed spectrogram having a bilinear function surface filling between the grid points on the time-frequency plane. Smoothed spectrogram calculation portion 10 executes the second processing (adaptation of the interpolation function using information on the fundamental frequency). By the processing up to smoothed spectrogram calculation portion 10, the speech sound signal is separated into a smoothed spectrogram and fine fundamental frequency information. Smoothed spectrogram transformation portion 11 and sound source information transformation portion 6 execute the third processing (transformation of speech sound parameters). Phasing portion 7 and waveform synthesis portion 8 execute the fourth processing (speech sound synthesis by the transformed speech sound parameters).

Figure 9:
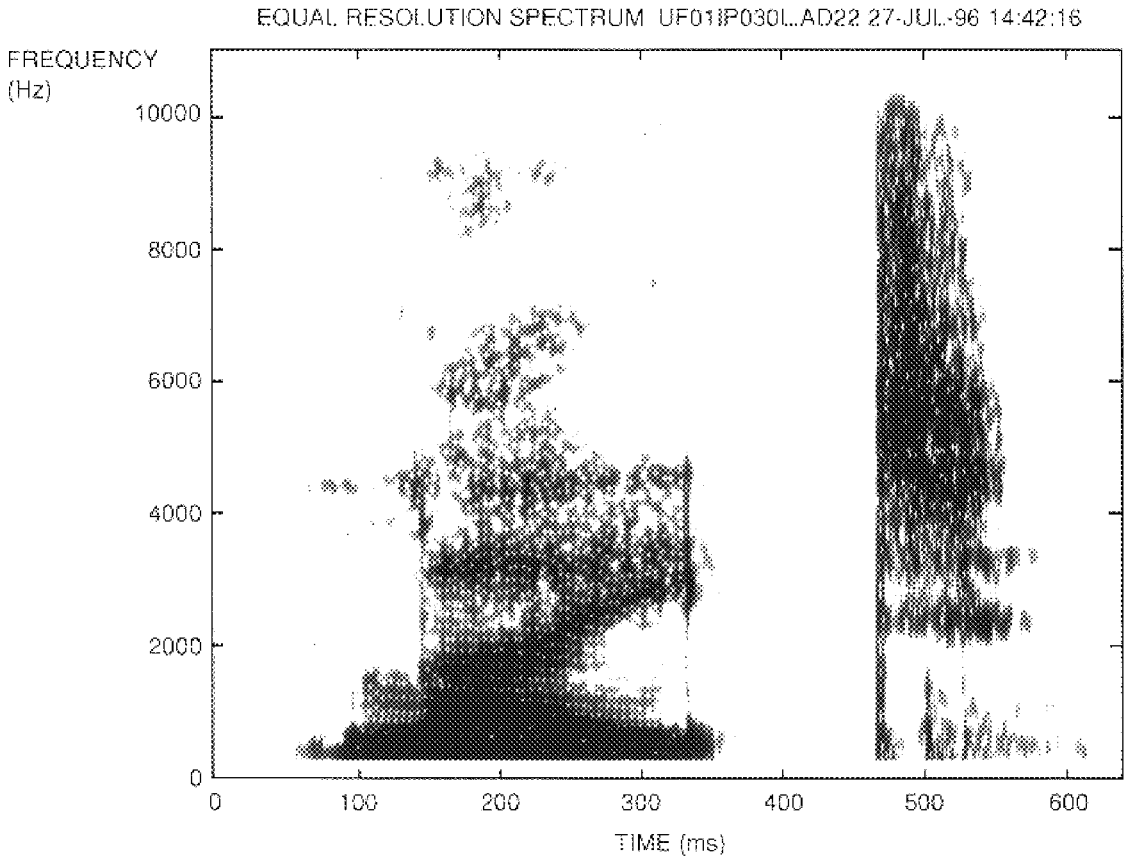
FIG. 9 shows a spectrogram prior to smoothing.
Figure 10:
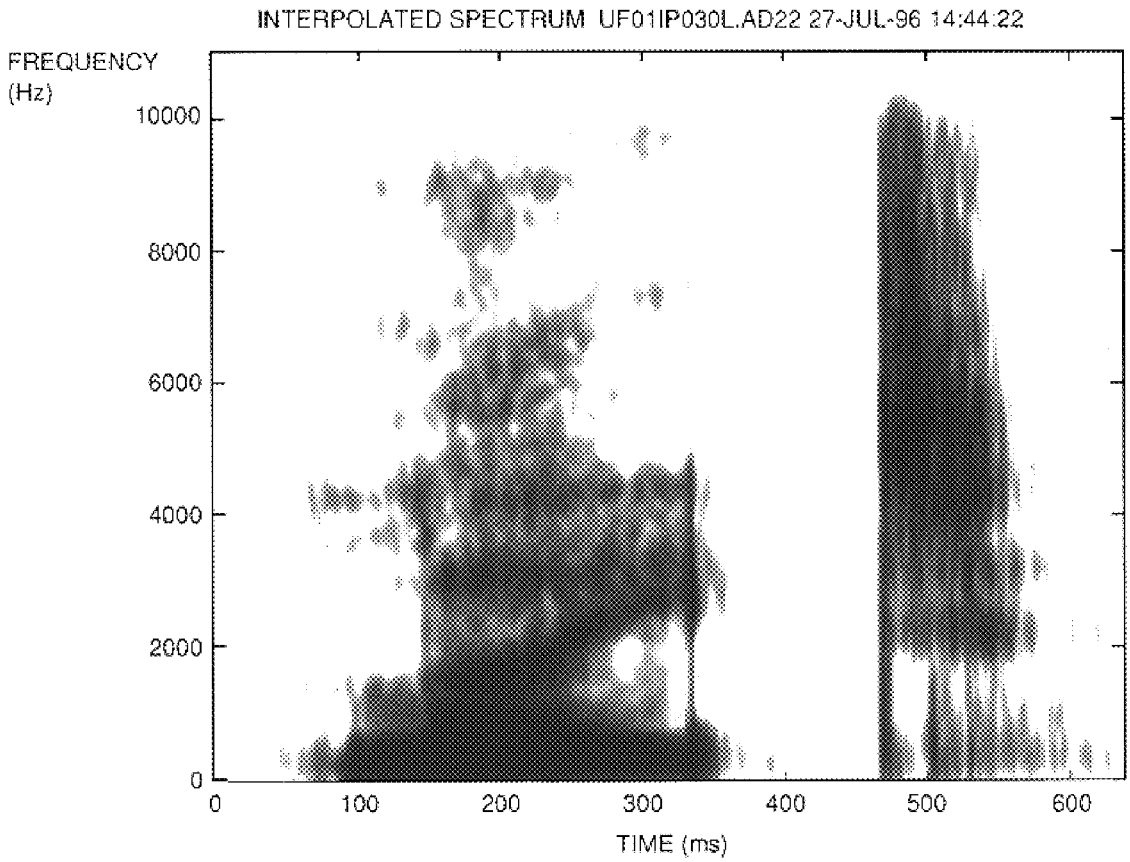
FIG. 10 shows a smoothed spectrogram.
Figure 11:
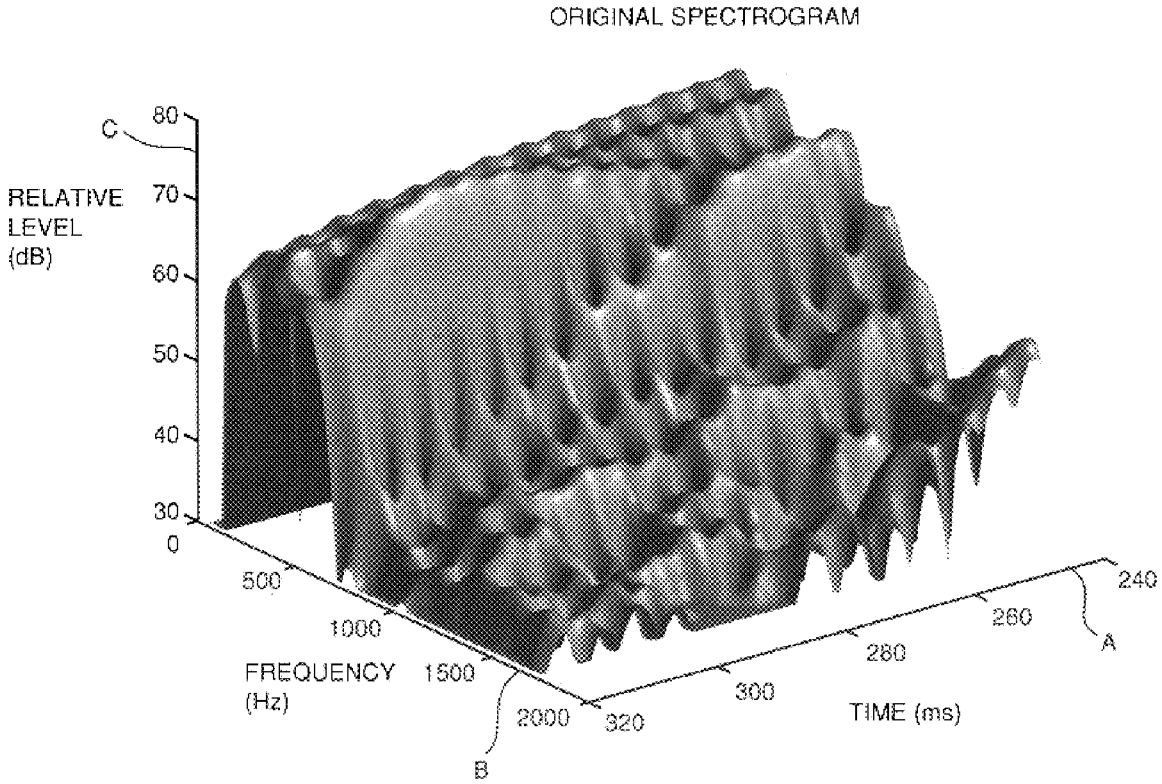
FIG. 11 three-dimensionally shows part of the spectrogram in FIG. 9.
Figure 12:
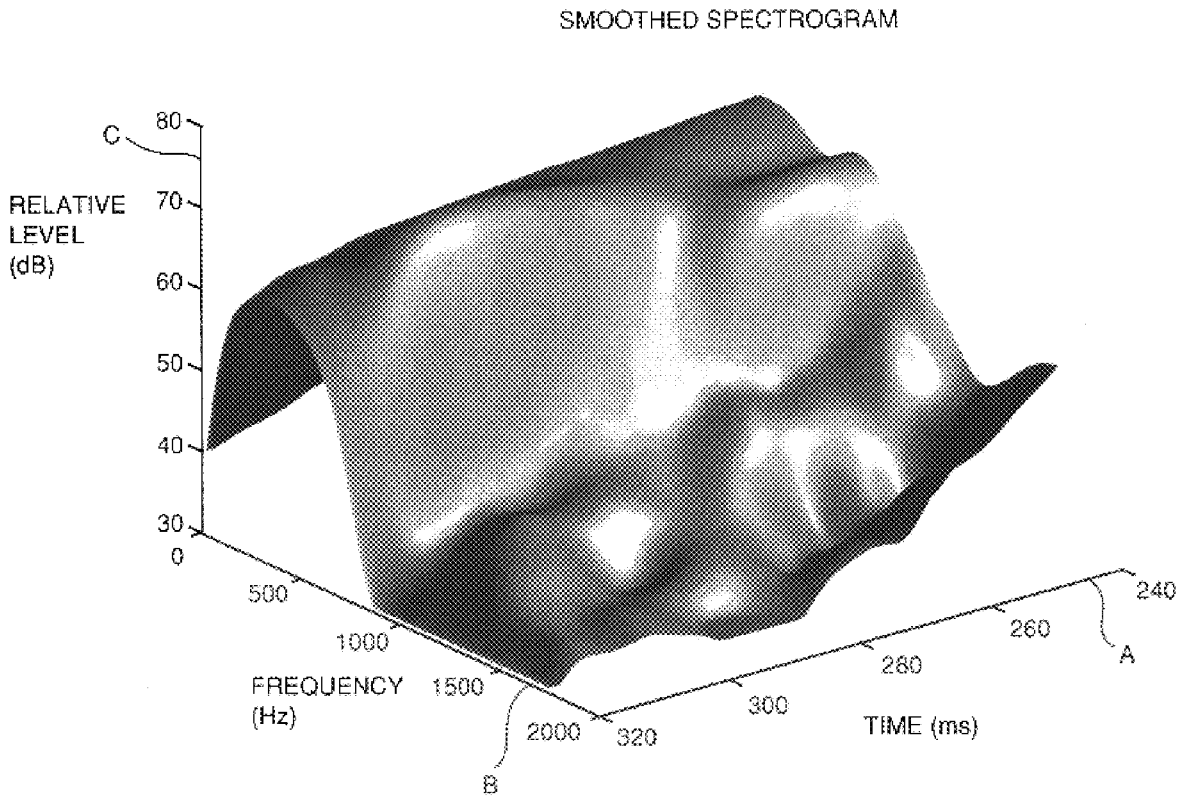
FIG. 12 three-dimensionally shows part of the spectrogram in FIG. 10.

FIG. 9 shows a spectrogram prior to smoothing. FIG. 10 shows a smoothed spectrogram. Referring to FIGS. 9 and 10, the abscissa represents time (ms) and the ordinate represents index indicating frequency. FIG. 11 three-dimensionally shows part of FIG. 9. FIG. 12 three-dimensionally shows part of FIG. 10. Referring to FIGS. 11 and 12, the A-axis represent time, the B-axis represents frequency, and the C-axis represents intensity.

Referring to FIGS. 9 and 11, zero points due to mutual interference of frequency components are observed. The zero points are shown as white dots in FIG. 9, and as "recess" in FIG. 11. Referring to FIGS. 10 and 12, it is observed that the zero points have disappeared. More specifically, the spectrogram has been smoothed, and the influence of the periodicity has been removed.

In the speech sound transformation method according to the second embodiment, smoothing is conducted not only in the direction of frequency of a spectrum to analyze but also in the temporal direction. More specifically, the spectrogram to analyze is smoothed. As a result, the influence of the periodicity of the spectrogram to analyze in the temporal direction and frequency direction can be reduced. Therefore, it is not necessary to excessively increase the frequency resolution, and therefore fine changes of the spectrogram to analyze in the temporal direction are not ruined. More specifically, the frequency resolution and the temporal resolution can be determined in a well balanced manner.

The speech sound transformation method according to the second embodiment includes all the processings in the speech second transformation method according to the first embodiment. The method according to the second embodiment therefore provides effects similar to the method according to the first embodiment. Furthermore, in the method according to the second embodiment, a spectrogram is smoothed rather than a spectrum. Therefore, the method according to the second embodiment provides effects similar to the effects brought about by the first embodiment, and the effects are greater than the first embodiment.

Third Embodiment

In the first embodiment, it is ignored that the spectrum to be smoothed at smoothed spectrum calculation portion 3 has already been smoothed by a time window which is used in analyzing the frequency at fundamental frequency calculation portion 2. Thus further smoothing a somewhat already smoothed spectrum by convolution with an interpolation function excessively flattens the fine structure of a section (spectrum) allying the frequency axis of a surface (time frequency surface representing a mechanism to produce a sound) which represents the time frequency characteristics of the speech sound, because the spectrum is smoothed double. The influence of the flattening of the fine structure may be recognized in deterioration of subtle nuances due to the individuality of the sound, the lively characteristic of voice, and the clearness of a phoneme.

In order to avoid such excessive smoothing, there is a method in which the model of a spectrum is adapted using only the values of nodes as described in "Power Spectrum Envelop (PSE) Speech Sound Analysis/Synthesis System" by Takayuki Nakajima and Torazo Suzuki, Journal of Acoustical Society of Japan, Vol.44, No. 11 (1988), pp824–832 (hereinafter referred to as "Document 1"). However, since a signal is not precisely periodic in an actual speech sound and contains various fluctuations and noises, which inevitably restricts the applicable range of Document 1. A method of sound analysis as a method of signal analysis according to the third embodiment includes the following processings in order to solve such a problem.

(Processings)

Processing 1 will be detailed. It is assumed that a surface representing the original time frequency characteristic (time frequency surface representing a mechanism to produce a speech sound) is a spatial element represented as the direct product of spaces formed by piecewise polynomials known as a spline signal space. An optimum interpolation function for calculating a surface in optimum approximation to a surface representing the original time frequency characteristic from a spectrogram influenced by a time window is desired. A time frequency characteristic is calculated using the optimum interpolation function. Such Processing 1 will be described in detail.

Assume that a surface representing the time frequency characteristic of a speech sound (time frequency surface representing a mechanism to produce a speech sound) is a surface represented by the product of a space formed by a piecewise polynomials in the direction of time and a space formed by a piecewise polynomials in the direction of frequency. In the first embodiment, for example, a surface representing the time frequency characteristic of a speech sound is represented by the product of a piecewise linear expression in the direction of time and a piecewise linear expression in the direction of frequency. Such parallel movement of polynomials can form a basis in a subspace in a space called L2 formed by a function which can be squared and integrated on a finite segment observed as described in "Periodic Sampling Basis and Its Biorthonormal Basis for the Signal Spaces of Piecewise Polynomials" by Kazuo Toraichi and Mamoru Iwaki, Journal of The Institute of Electronics Information and Communication Engineers, 92/6, Vol. J75-A, No. 6, pp. 1003–1012 (hereinafter referred to as "Document 2"). In the following, for simplification in illustration, a frequency spectrum, i.e., a section along the frequency axis of time frequency representation will be argued. The same argument applies to the time axis.

The condition required for an optimum interpolation function for the frequency axis is that a spectrum corresponding to the original basis (one basis which is an element of a subspace of L2) is reconstructed when that optimum interpolation function is applied to a smoothed spectrum produced by transforming a spectrum corresponding to one basis which is an element of a subspace in L2 through a smoothing manipulation in the frequency region corresponding to a time window manipulation. As described in Document 2, the element of the subspace in L2 is equivalent to a vector formed of an expansion coefficient by the basis. Therefore, the condition requested for the optimum interpolation function is equivalent to determining the optimum interpolation function so that only a single value is non-zero on nodes resulting from application of the optimum interpolation function to a smoothed spectrum produced by performing a smoothing manipulation in the frequency region corresponding to a time window manipulation to a spectrum corresponding to the original basis (the one basis which is the element of the subspace in space L2). The optimum interpolation function is an element of the same space, and therefore represented as a combination of basis. More specifically, the optimum interpolation function can be produced as a combination of basis using a coefficient vector with a part of the coefficient corresponding to a maximum value becoming non-negative and the others being zero when convoluted with a coefficient vector formed of values on nodes of the spectrum produced by performing the time window manipulation. Use of the produced optimum interpolation function on the frequency axis can remove the influence of excessive smoothing.

Processing 2 will be detailed . Processing 2 can be divided into Processings 2-1 and 2-2. The optimum interpolation function on the frequency axis produced in Processing 1 includes negative coefficients, and therefore negative parts may be derived in a spectrum after interpolation depending upon the shape of the original spectrum. Such a negative part derived in the spectrum does not cause any problem in the case of linear phase, but may generate a long term response due to the discontinuity of phases upon producing an impulse of a minimum phase and cause abnormal sound. Replacing the negative part with 0 for avoiding the problem causes a discontinuity (singularity) of a derivative at the portion changing from positive to negative, resulting in a relatively long term response to cause abnormal sound. To cope with the problem, Processing 2-1 is conducted. In Processing 2-1, the spectrum interpolated with an optimum interpolation function on the frequency axis is transformed with a monotonic and smooth function which mapps the region $(-\infty, \infty)$ to $(0, \infty)$.

The following problem is however encountered only with Processing 2-1. The energy of the spectrum of a speech sound largely varies depending upon the frequency band, and the ratio of variation may sometimes exceed 10000 times. In the term of human perception, fluctuations in each band may be perceived in proportion to a relative ratio with the average energy of the band. Therefore, in a small energy band, noises according to an error in approximation is clearly perceived. Therefore, if approximation is conducted in the same precision in all the bands during interpolation, approximation errors become more apparent in bands with smaller energies. In order to solve the disadvantage Processing 2-2 is conducted. In Processing 2-2, an outline spectrum produced by smoothing the original spectrum is used for normalization.

In summary, with respect to a spectrum normalized in Processing 2-2, interpolation is conducted using an optimum interpolation function on the frequency axis. Thus, approximation errors will be perceived uniformly between the bands. In addition, the average value of the spectrum will be 1 by such normalization, the spectrum interpolated by the optimum interpolation function on the frequency axis may be transformed into a non-negative spectrum without any singularity thereon, using a monotonic and smooth function which mapps the region of $(-\infty, \infty)$ to the region of $(0, \infty)$(Processing 2-1).

(Specific Processings)

Figure 13:
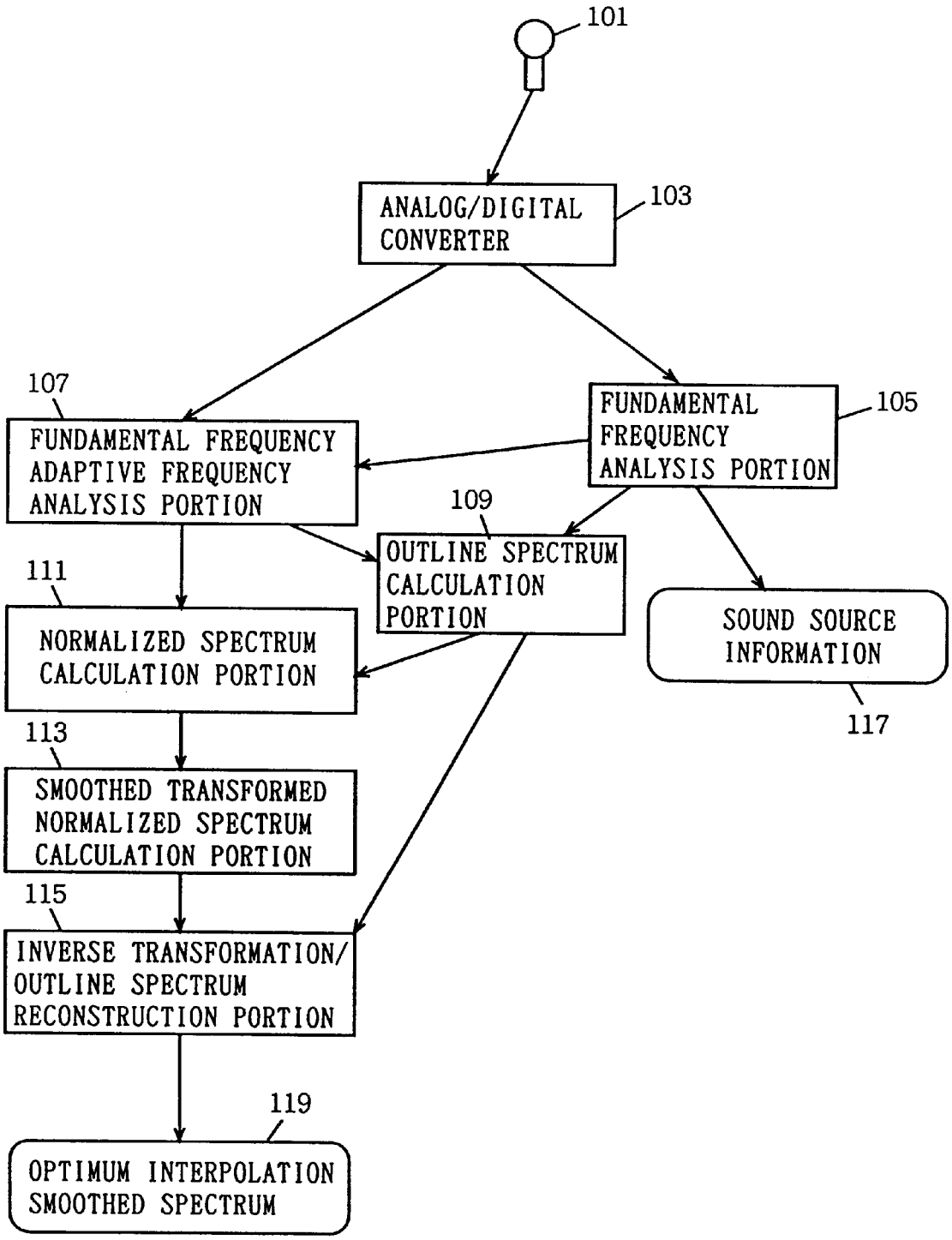
FIG. 13 is a schematic block diagram showing an overall configuration of a sound analysis device for implementing a speech sound analysis method according to a third embodiment of the invention.

FIG. 13 is a schematic block diagram showing an overall configuration of a speech sound analysis device for implementing a speech sound analysis method according to the third embodiment of the invention. Referring to FIG. 13, the speech sound analysis device includes a microphone 101, an analog/digital converter 103, a fundamental frequency analysis portion 105, a fundamental frequency adaptive frequency analysis portion 107, an outline spectrum calculation portion 109, a normalized spectrum calculation portion 111, a smoothed transformed normalized spectrum calculation portion 113, and an inverse transformation/outline spectrum reconstruction portion 115. The speech sound analysis device may be replaced with a frequency analysis device formed of power spectrum calculation portion 1, fundamental frequency calculation portion 2 and smoothed spectrum calculation portion 3 in FIG. 4. In this case, in smoothed spectrum transformation portion 5 in FIG. 4, an optimum interpolation smoothed spectrum 119 will be used in place of a smoothed spectrum.

Referring to FIG. 13, a speech sound is transformed into an electrical signal corresponding to a sound wave by microphone 101. The electrical signal may be used directly or may be once recorded by some recorder and reproduced for use. Then, the electrical signal from microphone 101 is sampled and digitized by analog-digital converter 103 into a speech sound waveform represented as a string of numerical values. As for the sampling frequency for the speech sound waveform, in the case of a high quality speaker telephone, 16 kHz may be used, and if application to music or broadcasting is considered, a frequency such as 32 kHz, 44.1 kHz, and 48 kHz is used. Quantization associated with the sampling is for example at 16 bits.

Fundamental frequency analysis portion 105 extracts the fundamental frequency or fundamental period of a speech sound waveform applied from analog-digital converter 103. The fundamental frequency or fundamental period may be extracted by various methods, an example of which will be described. The power spectrum of a speech sound multiplied by a $\cos^2$ window of 40 ms is divided by a spectrum smoothed by convolution with a smoothing function in the direction of frequency. Thus calculated power spectrum with a smoothed outline is band-limited to 1 kHz or less by a Gaussian window in the direction of frequency, and then subjected to an inverse Fourier transform to produce the position of the maximum value of a resulting modified autocorrelation function. Producing the detailed position of a maximum value by a parabolic interpolation using three points including the position of maximum value and points immediately before and after produces a precise fundamental period. The inverse of the fundamental period is a fundamental frequency. Since the value of modified autocorrelation function is 1 if the periodicity is perfect, and therefore the magnitude of this value may be used as an index for the strength of the periodicity.

Using the extracted information on the fundamental frequency or fundamental period (sound source information 117), the speech sound waveform from analog-digital converter 103 is subjected to frequency-analysis by a time window whose length is adaptively determined based on the fundamental frequency at fundamental frequency adaptive frequency analysis portion 107. If only optimum interpolation smoothed spectrum 119 is produced, the window length does not have to be changed according to the fundamental frequency, but if an optimum interpolation smoothed spectrogram will be later produced, use of a Gaussian window having a length corresponding to the fundamental frequency is most preferable. More specifically, the window calculated as follows will be used. A window function w(t) satisfying the condition is a Gaussian function as follows, the Fourier transform W(ω) of which is also given:

$$w(t)=e^{-\pi(t/\tau_0)^2} \tag{13}$$

$$w(\omega)=\frac{\tau_0}{\sqrt{2\pi}}e^{-\pi(\omega/\omega_0)^2} \tag{14}$$

wherein t is time, ω angular frequency, and $\omega_0$ is fundamental angular frequency. $\omega_0=2\pi f_0$, and $\tau_0=1/f_0$. $f_0$ is fundamental frequency, and $\tau_0$ is fundamental period.

A power spectrum obtained as a result of frequency analysis at fundamental frequency adaptive frequency analysis portion 107 is subjected to a high level smoothing through convolution with a window function in a triangular shape having a width 6 times that of the fundamental frequency, for example, and formed into an outline spectrum removed of the influence of the fundamental frequency. At normalized spectrum calculation portion 111, the power spectrum produced at fundamental frequency adaptive frequency analysis portion 107 is divided by the outline spectrum produced by outline spectrum calculation portion 109, and a normalized spectrum giving a uniform sensitivity of perception to approximation errors in respective bands is produced. Thus produced normalized spectrum having an overall flat frequency characteristic also has a locally raised shape on the spectrum called formant representing fine ridges and recesses or the characteristic of a glottis based on the periodicity of the speech sound. The above-described Processing 2-2 is thus performed at normalized spectrum calculation portion 111.

Figure 14:
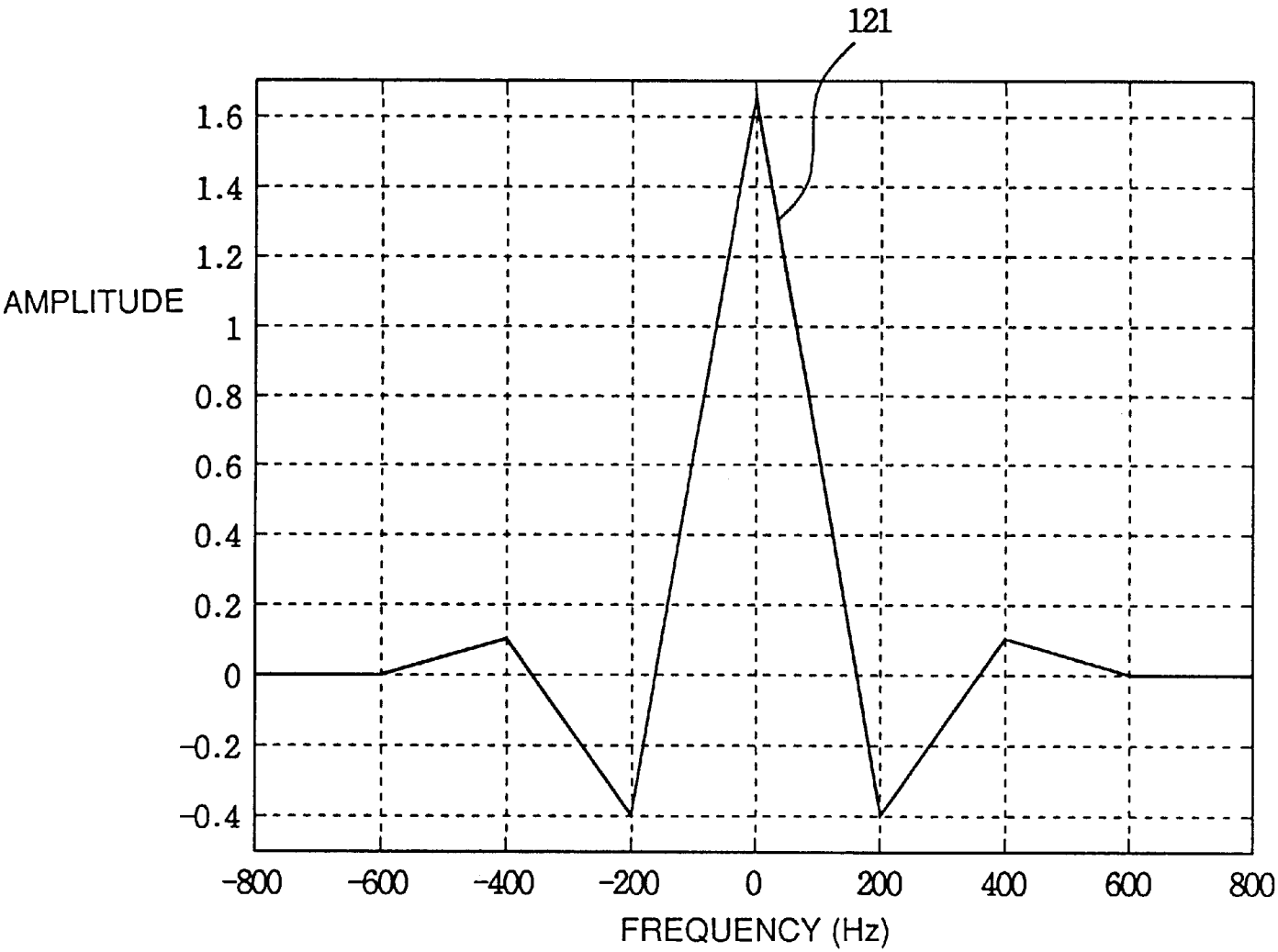
FIG. 14 shows an optimum interpolation smoothing function on a frequency axis which is used at a smoothed transformed normalized spectrum calculation portion in FIG. 13.

The normalized spectrum obtained at normalized spectrum calculation portion 111 is subjected to a monotonic non-linear transformation with respect to the value of each frequency at smoothed transformed normalized spectrum calculation portion 113. The normalized spectrum subjected to the non-linear transformation is convoluted with an optimum smoothing function 121 on the frequency axis shown in FIG. 14 which is formed by joining a time window and an optimum weighting factor given in the following table determined by the non-linear transformation, and formed into an initial value for the smoothed transformed normalized spectrum. The optimum smoothing function on the frequency axis is produced by Processing 1 as described above. More specifically, the optimum interpolation function on the frequency axis is produced by the representation of the time window in the frequency region and the basis of a space formed by a piecewise polynomial in the direction of frequency, and minimizes an error between the initial value of smoothed transformed normalized spectrum and a section along the frequency axis of the surface representing the time frequency characteristic of the speech sound. Note that the table given below includes optimum values when the window function is a Gaussian window mentioned before. The examples shown in FIG. 14 and in the following table include optimum smoothing functions assuming that the spectrum of a speech sound is a signal in a second order periodic spline signal space. A similar factor and smoothing function determined by such a factor may be produced assuming that the spectrum of a speech sound is generally a signal in an m-th order periodic spline signal.

TABLE 1

| Position | Factor |
|---|---|
| −3 | −0.0241 |
| −2 | 0.0985 |
| −1 | −0.4031 |
| 0 | 1.6495 |
| 1 | −0.4031 |
| 2 | 0.0985 |
| 3 | −0.0241 |

The initial value of thus produced smoothed transformed normalized spectrum sometimes includes negative values. Taking advantage of the fact that human sense is mainly keen of hearing ridges of a spectrum, the initial value of the smoothed transformed normalized spectrum is transformed using a monotonic smooth function which mapps segment $(-\infty, \infty)$ to $(0, \infty)$. More specifically, Processing 2-1 as described above is performed. More specifically, the following expression satisfies the condition, where a value before transformation is x and a value after transformation is $\eta(x)$:

$$\eta(x) = \frac{x + \log(2\cosh x)}{2} \tag{15}$$

Using $\eta(x)$, the initial value of smoothed transformed normalized spectrum is multiplied by an appropriate factor for normalization, and then transformed such that the result always takes a positive value. A spectrum resulting from such a transformation is divided by the factor used for the normalization to produce a smoothed transformed normalized spectrum.

The smoothed transformed normalized spectrum is subjected to the inverse transformation of the non-linear transformation used at smoothed transformed normalized spectrum calculation portion 113 by inverse transformation/outline spectrum reconstruction portion 115, once again multiplied by an outline spectrum, and formed into optimum interpolation smoothed spectrum 119. As information associated with sound source information 117, information on the fundamental frequency or fundamental period is recorded in the case of a voiced sound, and 0 is recorded for silence or a segment with no voiced sound. Optimum interpolation smoothed spectrum 119 retains information on the original speech sound up to fine details nearly completely and is smooth.

The series of processings as described above are very effective for improving the quality of speech sound analysis/speech sound synthesis. Using optimum interpolation smoothed spectrum 119 for speech sound synthesis/speech sound transformation permits the quality of synthesized speech sound/transformed speech sound to be so high that the sound cannot be discriminated against a natural speech sound. Since optimum interpolation smoothed spectrum 119 represents precise phoneme information retaining the individuality of a speaker or intricate nuance of the speech in a stably smooth form, large improvement in performance is expected if used as information representation in machine recognition of speech sound or as information representation to recognize a speaker. Since the influence of temporal fine structure of a sound source is nearly completely isolated, only the temporal fine structure of the sound source can be highly precisely extracted when optimum interpolation smoothed spectrum 119 is used as an inverse filter. This is very effective in applications such as diagnosis of speech quality or determination of speech pathological conditions. The method of speech sound analysis according to the first embodiment is a highly precise speech sound analysis method unaffected by excitation source conditions.

Fourth Embodiment

In the speech sound transformation method according to the second embodiment, a very high quality speech sound transformation is enabled by the method of producing a surface representing the time frequency characteristic of a speech sound signal by adaptive interpolation of a spectrogram in a time frequency region positively using the periodicity of the signal. However, if carefully compared to the original speech sound using headphones, retardation is recognized in the liveliness of the voice or the phoneme. This is mainly because of excessive smoothing, in other words because smoothing with a time window inevitable for calculation of a spectrogram and further smoothing by adaptive interpolation are overlapped.

The problems associated with such excessive smoothing will be detailed. In the second embodiment, a surface representing the time frequency characteristic of a speech sound is assumed to be a bilinear surface represented by a piecewise linear function with grid intervals being a fundamental frequency and a fundamental period in the directions of frequency and time. An operation to produce the piecewise linear function is implemented as a smoothing using an interpolation function in the time frequency region when grid point information is given, which enables the surface to be stably produced without destruction even if an incomplete cycle or a non-periodic signal is encountered in an actual speech sound. The operation however ignores the problem that a spectrogram to be smoothed has already been smoothed by a time window used in analysis. This is because the condition of retaining the original surface is generally satisfied in the second embodiment.

In the second embodiment, what has been somehow already smoothed is further smoothed by convolution with an interpolation function, in other words, smoothing is conducted double, and the fine structure of the surface is flattened. If compared to the original sound, the influence of thus flattened fine structure is recognized as retardation in the intricate nuance by the individuality of a speech sound, the liveliness of a voice, and the clearness of phonemes.

One method of avoiding such disadvantage associated with excessive smoothing is a method of adapting a spectral model using only values of nodes as described in Document 1. The method of Document 1 however simply proposes a spectral model at a certain time without considering the time frequency characteristic. According such a method, resolution in the direction of time is lowered, and quick changes in time cannot be captured. Furthermore, in an actual speech sound, a signal is not precisely periodic and includes various noises, the range of application of such a method is inevitably limited. If a value in an isotropic grid point is produced in the time frequency region, using an optimum Gaussian window in which the time frequency resolution matches the fundamental period of a speech sound, in an extended interpretation of the method as described in Document 1, the value includes the influence of grid points adjacent to each other, and cannot be used for precisely reconstructing the surface representing the inherent time frequency characteristic.

The fourth embodiment proposes a method of calculating a surface representing a precise time frequency characteristic removed of the influence of excessive smoothing as described above, and improves the analysis portion used in the speech sound transformation method according to the second embodiment. In addition, the fourth embodiment provides a highly precise analysis method unaffected by excitation source conditions for various applications which need analysis of speech sounds. The speech sound analysis method as a signal analysis method according to the fourth embodiment will be detailed.

(Processings)

Now, Processing 3 will be detailed. In Processing 3, an optimum interpolation function on the time axis is produced similarly to Processing 1. In other words, an optimum interpolation function on the time axis is produced from the representation of a window function in a time region and a basis of a space formed by a piecewise polynomial in the time direction. Processing 4 will be described. Processing 4 is divided into Processings 4-1 and 4-2. The optimum interpolation function on the time axis produced in Processing 3 includes negative values, and therefore negative portions may be derived in a spectrogram after interpolation depending upon the shape of the original spectrogram. The negative portion thus derived in the spectrogram does not cause any problem in the case of linear phases, but may cause a long term response by the discontinuity of phase upon producing a minimum phase impulse. Replacing the negative portion with zero in order to avoid such a problem generates the discontinuity (singularity) of a derivative in the portion changing from positive to negative, resulting in a relatively long term response to cause abnormal sounds. To cope with the problem, Processing 4-1 is conducted. In Processing 4-1, using a monotonic and smooth function which mapps the region of $(-\infty, \infty)$ to the region of $(0, \infty)$, a spectrogram interpolated with an optimum interpolation function on the time axis is transformed. The following problem is encountered by simply performing Processing 4-1. Energy included in a spectrum of a speech sound largely varies between frequency bands, the ratio sometimes exceeds 10000 times. In terms of human perception, fluctuations in each band are perceived in proportion to a relative ratio to the average energy of the band. Therefore, noise due to approximation errors are clearly perceived in smaller energy bands. If approximation is performed in the same precision in all the bands upon interpolation, approximation errors become more apparent in smaller energy bands. In order to solve such a problem, Processing 4-2 is conducted. In Processing 4-2, the original spectrogram is normalized with a smoothed spectrogram.

In summary, an interpolation with an optimum interpolation function on the time axis is conducted to a spectrogram normalized by Processing 4-2. Thus, approximation errors will be equalized in terms of perception between bands. In addition, since the average value of the spectrogram becomes 1 by such normalization, a spectrogram interpolated with an optimum interpolation function on the time axis can be transformed into a non-negative spectrogram without any singularity thereon, using a monotonic and smooth function which mapps the region of $(-\infty, \infty)$ to the region of $(0, \infty)$(Processing 4-1).

(Specific processings)

Figure 15:
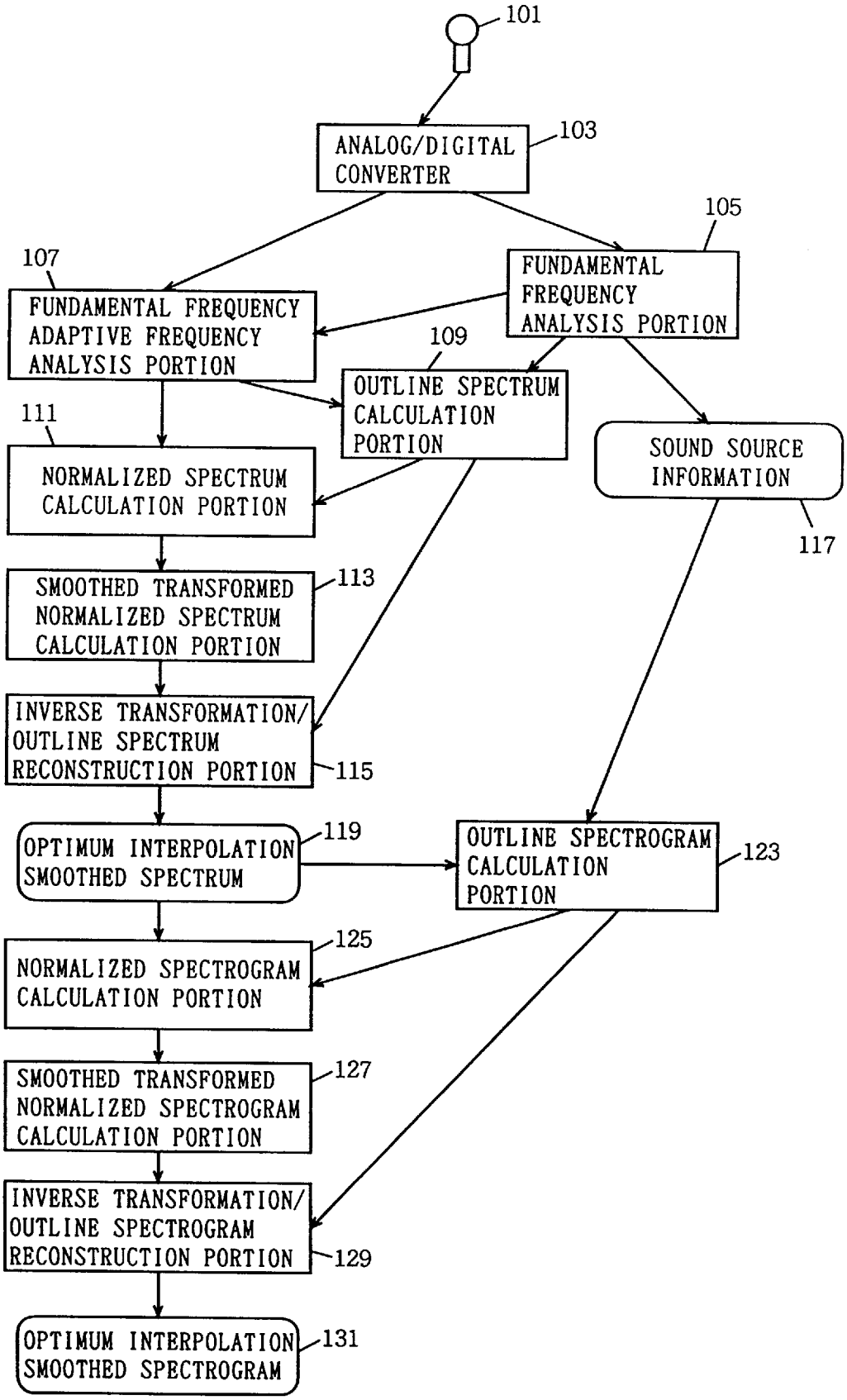
FIG. 15 is a schematic diagram showing an overall configuration of a signal analysis device for implementing a signal analysis method according to a fourth embodiment of the invention.

FIG. 15 is a schematic block diagram showing an overall configuration of a speech sound analysis device for implementing the speech sound analysis method according to the fourth embodiment of the invention. Portions similar to those in FIG. 13 are denoted with the same reference numerals and characters with a description thereof being omitted. Referring to FIG. 15, the speech sound analysis device includes a microphone 101, an analog-digital converter 103, a fundamental frequency analysis portion 105, a fundamental frequency adaptive frequency analysis portion 107, an outline spectrum calculation portion 109, a normalized spectrum calculation portion 111, a smoothed transformed normalized spectrum calculation portion 113, an inverse transform/outline spectrum reconstruction portion 115, an outline spectrogram calculation portion 123, a normalized spectrogram calculation portion 125, a smoothed transformed normalized spectrogram calculation portion 127, and an inverse transform/outline spectrogram reconstruction portion 129. The speech sound analysis device may be replaced with a speech sound analysis device formed of power spectrum calculation portion 1, fundamental frequency calculation portion 2, adaptive frequency analysis portion 9 and smoothed spectrogram calculation portion 10 as shown in FIG. 8. In that case, at smoothed spectrogram transformation portion 11, optimum interpolation smoothed spectrogram 131 is used in place of the smoothed spectrogram.

Referring to FIG. 15, optimum interpolation smoothed spectrum 119 is calculated for each analysis cycle. For a fundamental frequency of a speech sound up to 500 Hz, analysis is conducted for every 1 ms. Arranging in time order optimum interpolation smoothed spectrum 119 calculated every 1 ms for example permits a spectrogram based on the optimum interpolation smoothed spectrum to be produced. The spectrogram is however not subjected to optimum interpolation smoothing in the time direction, and therefore is not optimum interpolation smoothed spectrogram 131. Outline spectrogram calculation portion 123, normalized spectrogram calculation portion 125, smoothed transformed normalized spectrogram calculation portion 127 and inverse transform/outline spectrogram reconstruction portion 129 function to calculate optimum interpolation smoothed spectrogram 131 from the spectrogram based on optimum interpolation smoothed spectrum 119.

At outline spectrogram calculation portion 123, the segments of three fundamental periods each immediately before and after a current analysis point (six fundamental periods in total) are selected from a spectrogram based on optimum interpolation smoothed spectrum 119, a weighted summation is performed using a triangular weighting function with the current point as a vertex to calculate the value of outline spectrum at the current point. Thus calculated spectrum is arranged in the direction of time to produce the outline spectrogram. More specifically, the outline spectrogram is produced by removing the influence of fluctuations in time due to the periodicity of a speech sound signal from the spectrogram based on optimum interpolation smoothed spectrum 119.

At normalized spectrogram calculation portion 125, the spectrogram based on optimum interpolation smoothed spectrum 119 is divided by the outline spectrogram obtained by outline spectrogram calculation portion 123 to produce a normalized spectrogram. Thus, a normalization is conducted according to the level of each position in the direction of time while local fluctuations still remain, and influences upon perception of approximation errors become uniform. Normalized spectrogram calculation portion 125 thus performs Processing 4-2.

At smoothed transformed normalized spectrogram calculation portion 127, the normalized spectrogram obtained at normalized spectrogram calculation portion 125 is subjected to an appropriate monotonic non-linear transformation. A spectrogram resulting from the non-linear transformation is subjected to a weighted calculation with an optimum smoothing function 133 on the time axis shown in FIG. 16 formed by joining a time window and an optimum weighting factor shown in a table determined by non-linear transformation (the table shown in the third embodiment), and is formed into a set of initial values of a spectral section of the smooth transformed normalized spectrogram. Such optimum smoothing function 133 on the time axis is produced by Processing 3, and minimizes an error between initial values of the spectral section of the smooth transformed normalized spectrogram and the spectral section of the surface representing the time frequency characteristic of the speech sound.

Figure 16:
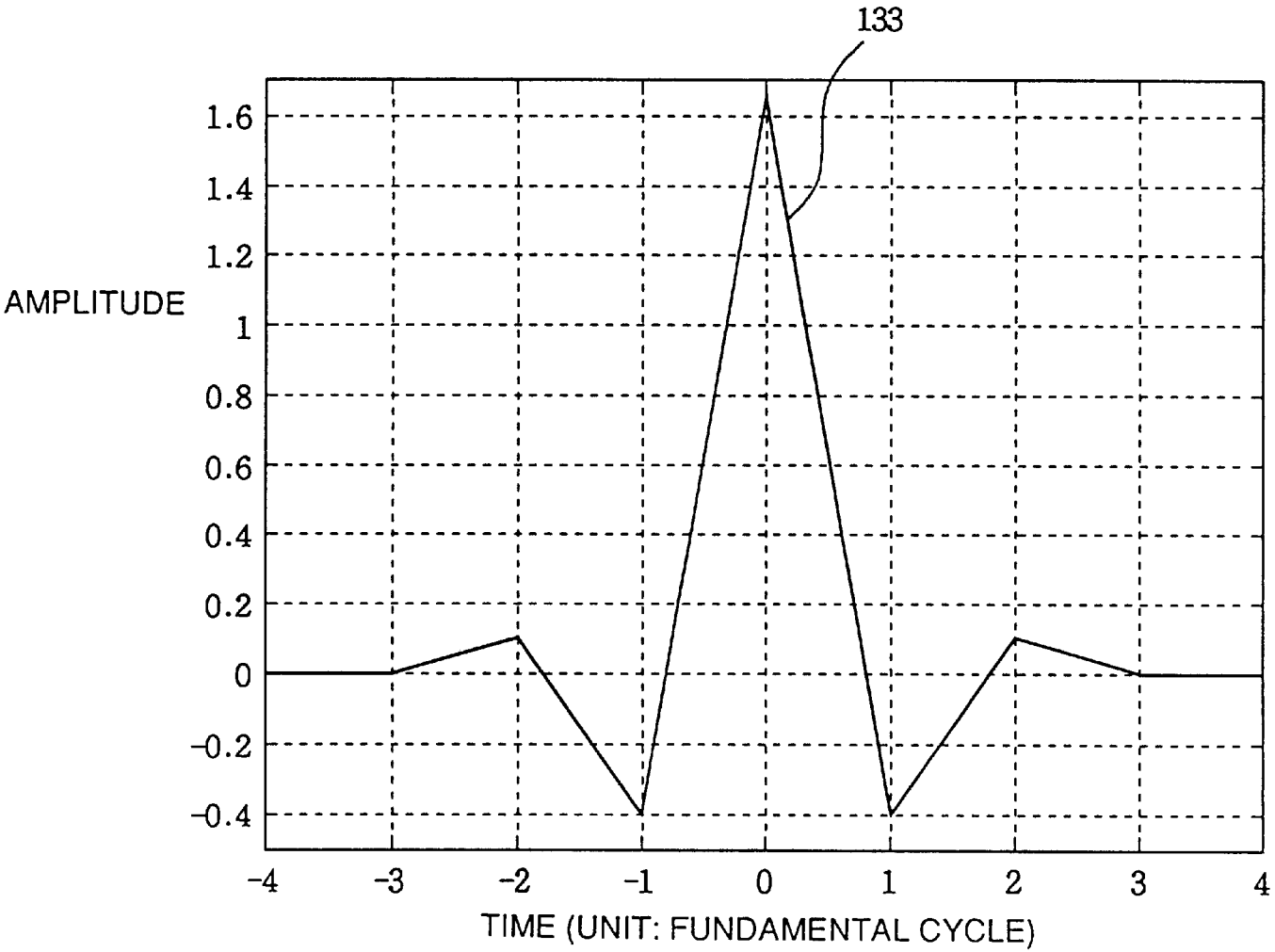
FIG. 16 shows an optimum interpolation smoothing function on the time axis used at a smoothed transformed normalized spectrogram calculation portion in FIG. 15.

The example of table shown in FIG. 16 and the third embodiment corresponds to an optimum smoothing function assuming that fluctuations of the spectrogram of a speech sound in time is a signal in a second order periodic spline signal space. A similar factor and a smoothing function determined by such a factor can be produced assuming that the temporal fluctuation of the spectrogram of a speech sound generally corresponds to a signal in an m-th order periodic spline signal space.

Thus produced initial values of the spectral section of the smoothed transformed normalized spectrogram sometimes include a negative value. Taking advantage of the fact that human sense is keen of hearing a rising of a sound, the initial values of the spectral section of the smooth transformed normalized spectrogram are transformed using a monotonic smoothed function which mapps the segment of $(-\infty, \infty)$ to the segment of $(0, \infty)$. In other words Processings 4-1 described above is performed. More specifically, if the value before transformation is x and the value after transformation is $\eta(x)$, the following expression satisfies the condition.

$$\eta(x) = \frac{x + \log(2\cosh x)}{2} \tag{16}$$

Using $\eta(x)$, the initial values of the spectrum section of the smooth transformed normalized spectrogram are multiplied by an appropriate factor for normalization, then transformed so as to always take a positive value, and a spectrum obtained by the transformation is divided by the factor used for the normalization. The processing is conducted for all the initial values of the spectrum section of the smooth transformed normalized spectrogram, and a plurality of spectra results. The plurality of spectra are arranged in the direction of time to be a smoothed transformed normalized spectrogram.

At inverse transform/outline spectrogram reconstruction portion 129, the smoothed transformed normalized spectrogram is subjected to the inverse transform of the non-linear transformation used at smooth transformed normalized spectrogram calculation portion 127, and is once again multiplied by an outline spectrogram to be an optimum interpolation smoothed spectrogram 131.

As in the foregoing, the speech sound analysis method according to the fourth embodiment includes all the processings included in the speech sound analysis method according to the third embodiment. Therefore, the speech sound analysis method according to the fourth embodiment gives similar effects to the third embodiment. The speech sound analysis method according to the fourth embodiment however takes into account not only the direction of frequency but also the direction of time. More specifically, in addition to Processings 1 and 2 described in the third embodiment, Processings 3 and 4 are performed. The effects brought about by the fourth embodiment are greater than those by the speech sound analysis method according to the third embodiment. Use of the speech sound analysis method according to the fourth embodiment therefore further improves the quality of speech sound analysis/speech sound synthesis as compared to the case of using the speech sound analysis method according to the third embodiment, particularly in the liveliness of the start of a consonant or a speech.

Fifth Embodiment

When a time window having such an equal resolution that a temporal resolution and a frequency resolution are in the same ratio with respect to a fundamental period and a fundamental frequency, a point which periodically becomes 0 is generated on a spectrogram due to interference between harmonics of a periodic signal. The point to be 0 results, because the phases of adjacent harmonics rotate in one fundamental period, and therefore a portion to be in anti phase in average is periodically derived. In the description of the second embodiment in conjunction with FIG. 12, use of the speech sound transformation method according to the second embodiment eliminates a point to be zero in a spectrogram. Note that the point to be zero is the point whose amplitude becomes zero.

In order to solve such a problem, a window function to give a spectrogram to take a maximum value at the portion of the point which just becomes zero is designed. Among numerous such window functions, one can be specifically formed as follows. Window functions of interest are placed on both sides of the origin apart at an interval of the fundamental period amount of a speech sound signal. One of the window functions has its sign inverted. The window function having its sign inverted is added with the other window function to produce a new window function. The new window function has an amplitude half the original window functions. A spectrogram calculated using thus obtained new window function has a maximum value at the position of a point to be zero in the spectrogram obtained using the original window function, and has a point to be zero at the position at which the spectrogram obtained using the original window function has a maximum value. The spectrogram in power representation calculated using the original window functions, a spectrogram in power representation calculated using the newly produced window function and a monotonic non-negative function are added and subjected to an inverse transformation, the points to be zero and the maximum values cancel each other, and a flat and smoothed spectrogram results. Now, a detailed description follows in conjunction with the accompanying drawings.

Figure 17:
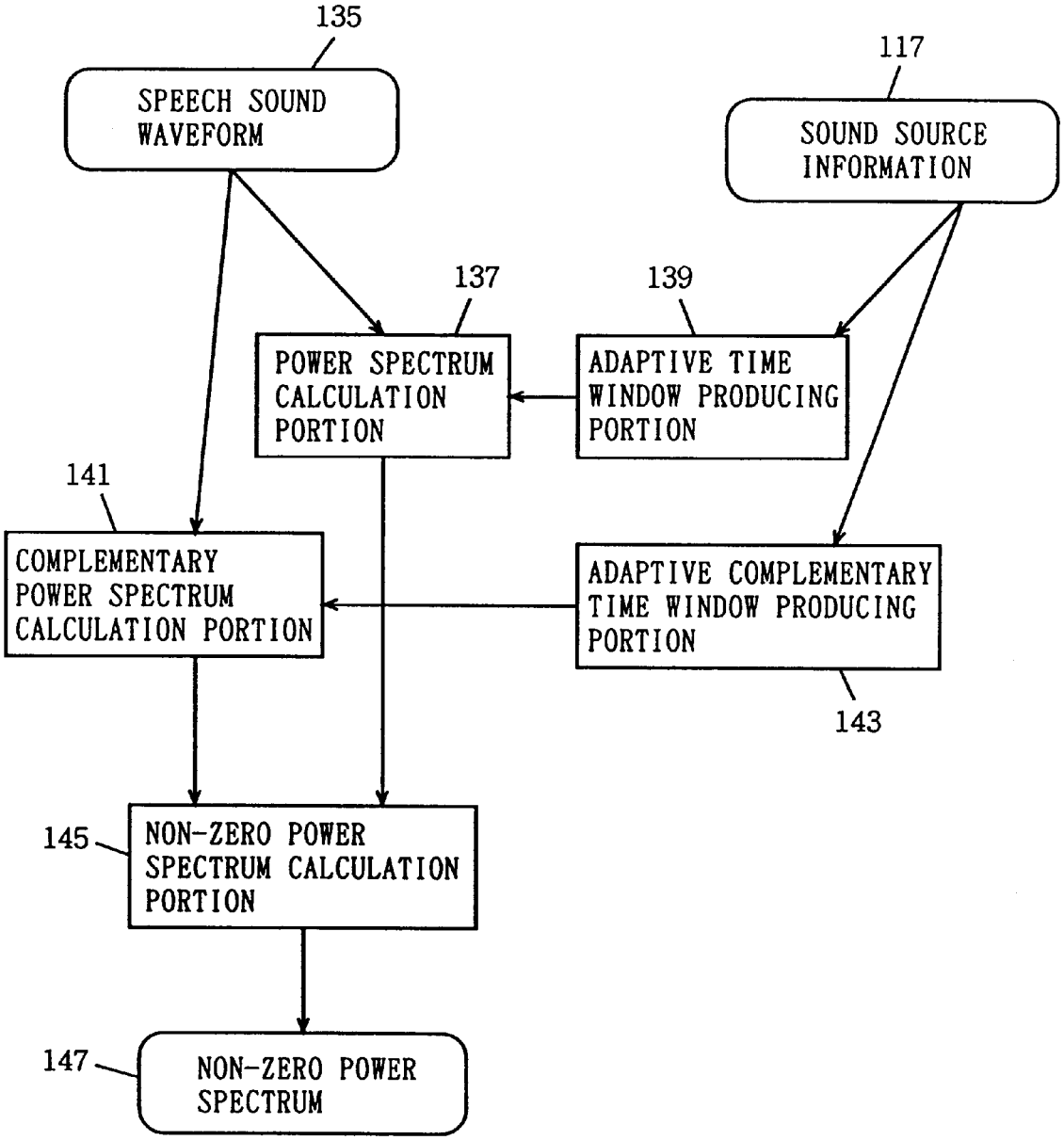
FIG. 17 is a schematic block diagram showing an overall configuration of a speech sound analysis device for implementing a speech sound analysis method according to a fifth embodiment of the invention.

FIG. 17 is a schematic block diagram showing an overall configuration of a speech sound analysis device for implementing the speech sound signal analysis method according to the fifth embodiment of the invention. Referring to FIG. 17, the speech sound analysis device includes a power spectrum calculation portion 137, an adaptive time window producing portion 139, a complementary power spectrum calculation portion 141, an adaptive complementary time window producing portion 143 and a non-zero power spectrum calculation portion 145. Fundamental frequency adaptive frequency analysis portion 107 shown in FIGS. 13 and 15 may be replaced with the speech sound analysis device shown in FIG. 17. In that case, outline spectrum calculation portion 109 and normalized spectrum calculation portion 111 shown in FIG. 13 will use a non-zero power spectrum 147 in place of the spectrum obtained at fundamental frequency adaptive frequency analysis portion 107. Note that sound source information 117 is the same as sound source information 117 shown in FIG. 13, and a speech sound waveform 135 is applied from analog/digital converter 103 shown in FIG. 13.

Based on information on the fundamental frequency or fundamental period of sound source information 117, adaptive time window producing potion 139 produces such a window function that the temporal resolution and frequency resolution of the time window have an equal relation relative to the fundamental frequency and cycle. The window function to satisfy the condition (hereinafter referred to as "adaptive time window") w(t) is a Gaussian function as follows, and its Fourier transform W(ω) is given as well:

$$w(t)=e^{-\pi(t/\tau_0)^2} \tag{17}$$

$$W(\omega)=\frac{\tau_0}{\sqrt{2\pi}}e^{-\pi(\omega/\omega_0)^2} \tag{18}$$

wherein t is time, ω angular frequency, $\omega_0$ fundamental angular frequency, and $\tau_0$ fundamental period. $\omega_0=2\pi f_0$, $\tau_0=1/f_0$, and $f_0$ is fundamental frequency. At adaptive complementary time window producing portion 143, simultaneously with the producing of the adaptive time window at adaptive time window producing portion 139, a time window complementary to the adaptive time window (hereinafter referred to as "adaptive complementary time window") is produced. More specifically, the adaptive time window and a window function having the same shape are positioned apart from each other at an interval of a fundamental period on opposite sides of the origin. One of the window functions has its sign inverted and added with the other window function to produce adaptive complementary time window $w_d(t)$. Its amplitude will be half that of the original window function (adaptive time window). Adaptive complementary time window $w_d(t)$ can be more specifically expressed for a Gaussian window as follows;

$$w_d(t)=\frac{1}{2}\left(e^{-\pi\left(\frac{t-\tau_0/2}{\tau_0}\right)^2}-e^{-\pi\left(\frac{t+\tau_0/2}{\tau_0}\right)^2}\right) \tag{19}$$

Figure 18:
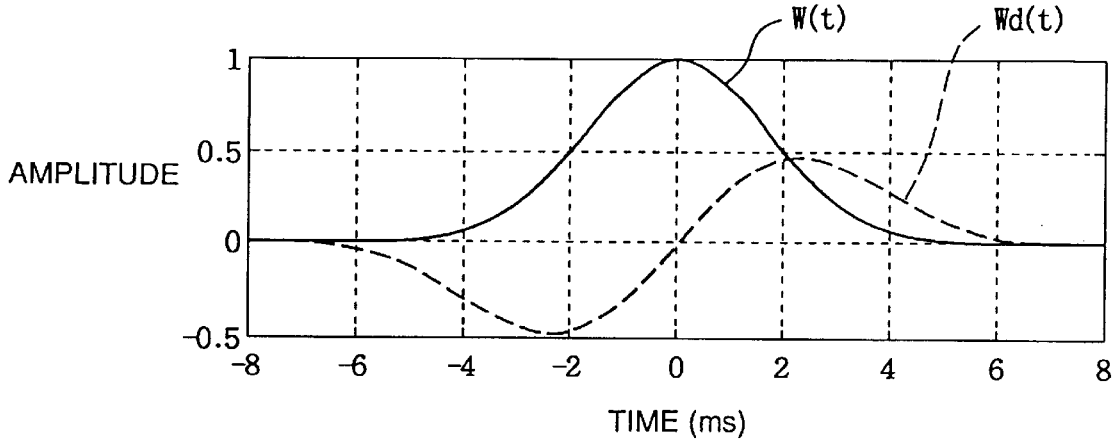
FIG. 18 shows an adaptive time window w(t) obtained at an adaptive time window producing portion in FIG. 17 and an adaptive complimentary time window $w_d(t)$ obtained at an adaptive complimentary time window producing portion in FIG. 17.
Figure 19:
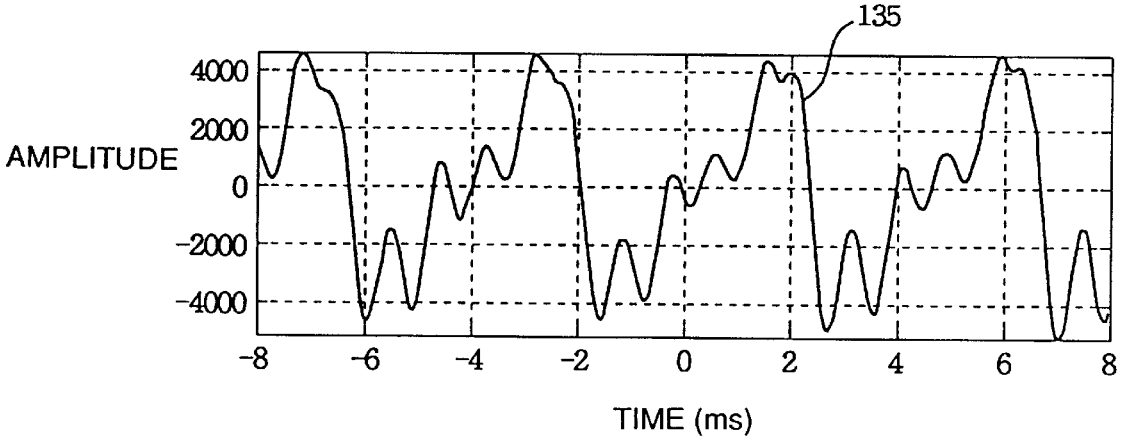
FIG. 19 shows an example of a speech sound waveform in FIG. 17.

FIG. 18 shows adaptive time window w(t) and adaptive complementary time window $w_d(t)$. FIG. 19 is a chart showing an actual speech sound waveform corresponding to adaptive time window w(t) and adaptive complementary time window $w_d(t)$. Referring to FIGS. 18 and 19, the ordinate represents amplitude and the abscissa time (ms). Adaptive time window w(t) and adaptive complementary time window $w_d(t)$ in FIG. 18 correspond to the fundamental frequency of a speech sound waveform (part of a female voice "O") in FIG. 19.

Referring back to FIG. 17, at power spectrum calculation portion 137, using the adaptive time window produced at adaptive time window producing portion 139, speech sound waveform 135 is analyzed in terms of frequency to produce a power spectrum. At the same time, at complementary power spectrum calculation portion 141, using the adaptive complementary time window produced at adaptive complementary time window producing portion 143, speech sound waveform 135 is analyzed in terms of frequency to produce a complementary power spectrum.

At non-zero power spectrum calculation portion 145, power spectrum $P^2(\omega)$ produced at power spectrum calculation portion 137 and complementary power spectrum $$P_c^2(\omega)$$

produced at complementary power spectrum calculation portion 141 are subjected to the following calculation to produce a non-zero power spectrum 147. Herein, non-zero power spectrum 147 is expressed as $$P_{nz}^2(\omega).$$

$$P_{nz}^2(\omega)=P^2(\omega)+P_c^2(\omega) \tag{20}$$

A plurality of non-zero power spectra 147 thus produced are arranged in time order to obtain a non-zero power spectrogram.

Figure 20:
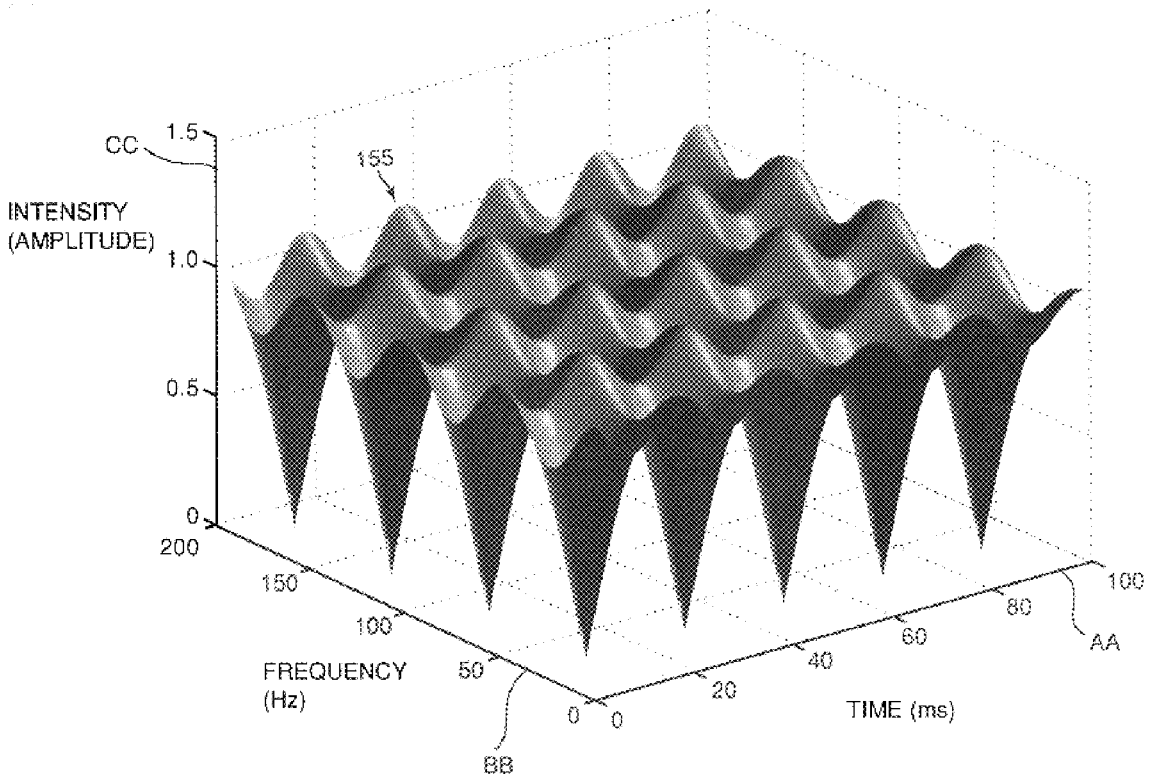
FIG. 20 shows a three-dimensional spectrogram p(ω) formed of a power spectrum $P^2(\omega)$ produced using adaptive time window w(t) in FIG. 18 for a periodic pulse train.
Figure 21:
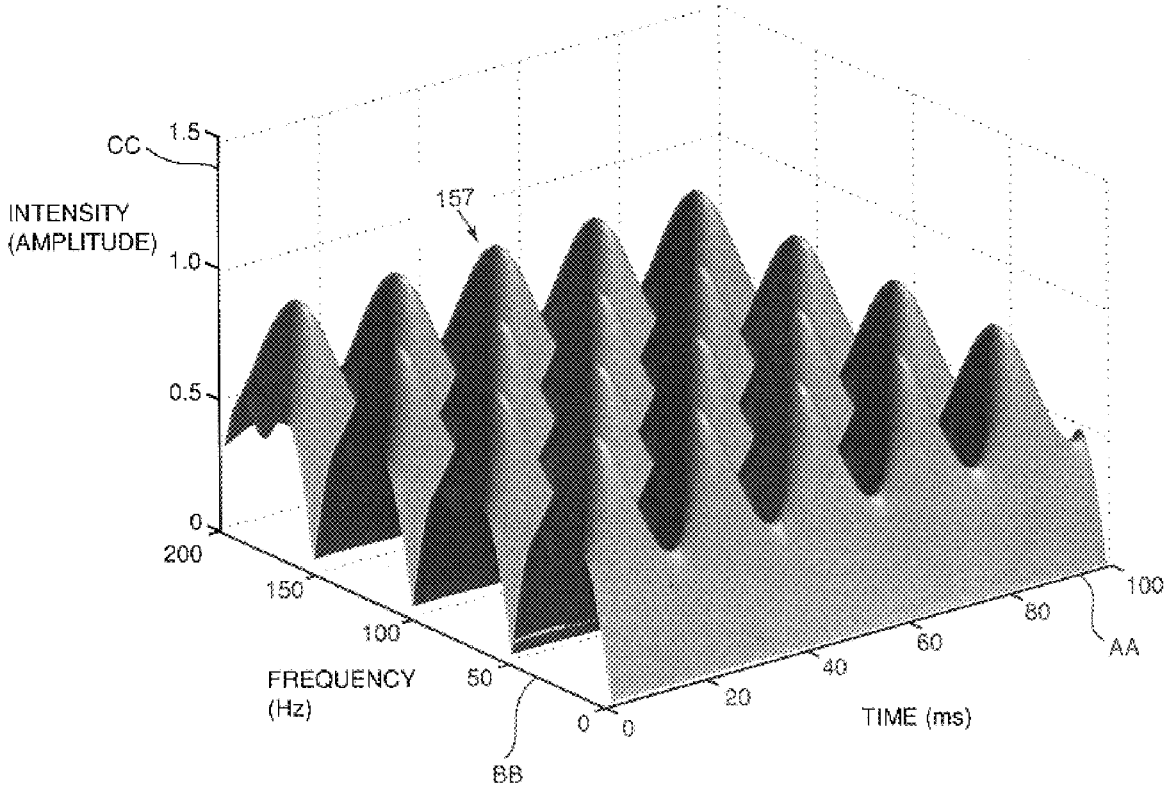
FIG. 21 shows a three-dimensional complimentary spectrogram $P_c(\omega)$ formed of a complimentary power spectrum $P^2_c(\omega)$ produced using adaptive complimentary time window $w_d(t)$ in FIG. 18 for a periodic pulse train.
Figure 22:
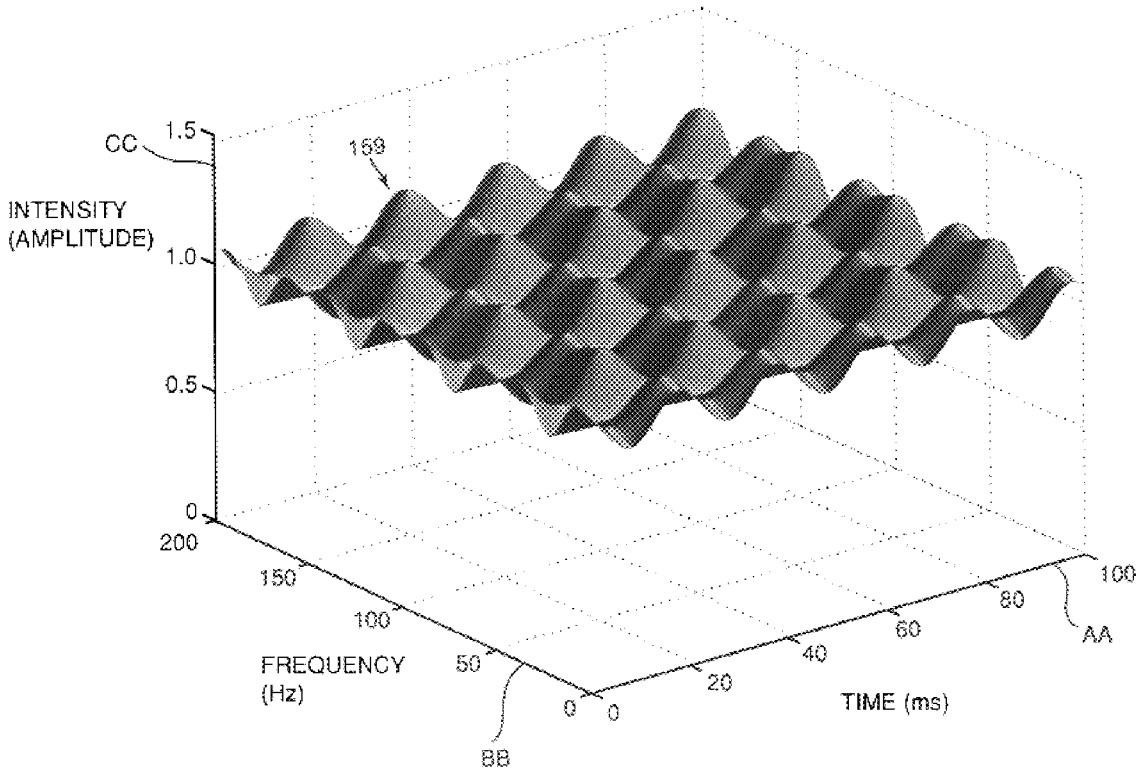
FIG. 22 shows a three-dimensional non-zero power spectrogram $P_{nz}(\omega)$ formed of a non-zero power spectrum $P^2_{nz}(\omega)$ for a periodic pulse train obtained at a non-zero power spectrum calculation portion in FIG. 17.

Using an example of analysis of a pulse train of a constant period, how the speech sound analysis method according to the fifth embodiment functions will be detailed. FIG. 20 shows a three-dimensional spectrogram P(ω) formed of power spectrum $P^2(\omega)$ produced using the adaptive time window to the periodic pulse train. FIG. 21 shows a three-dimensional complementary spectrogram $P_c(\omega)$ formed of complementary power spectrum $$P_c^2(\omega)$$

produced using the adaptive complementary time window to the periodic pulse train. FIG. 22 shows a three-dimensional non-zero spectrogram $P_{nz}(\omega)$ formed of non-zero power spectrum $$P_{nz}^2(\omega)$$

of the periodic pulse train. Referring to FIGS. 20 to 22, the AA axis represents time (in arbitrary scale), the BB axis represents frequency (in arbitrary scale), and C axis represents intensity (amplitude). Referring to FIG. 20, three-dimensional spectrogram 155 has a surface value periodically fallen to zero by the presence of a point to be zero. Referring to FIG. 21, the portion with such a point to be zero in the three-dimensional spectrogram shown in FIG. 20 takes a maximum value in three-dimensional complementary spectrogram 157. Referring to FIG. 22, a three-dimensional non-zero spectrogram 159 obtained as an average of three-dimensional spectrogram 155 and three-dimensional complementary spectrogram 157 takes a smoothed shape close to flatness with no point to be zero.

As in the foregoing, in the speech sound analysis method according to the fifth embodiment, a spectrum with no point to be zero and a spectrogram with no point to be zero can be produced. Thus produced spectrum without any point to be zero is used at outline spectrum calculation portion 109 and normalized spectrum calculation portion 111 in FIG. 13, and then the precision of approximation of a section along the frequency axis of a surface representing the time frequency characteristic of a speech sound can be further improved as compared to the speech sound analysis method according to the third embodiment. If a spectrogram without any point to be zero is used at outline spectrum calculation portion 109 and normalized spectrum calculation portion 111 in FIG. 15, the precision of approximation of a surface representing the time frequency characteristic of a speech sound can be further improved as compared to the speech sound analysis method according to the fourth embodiment. Note that in place of using $$P_c^2(\omega),\quad P_c^2(\omega)$$

is multiplied by a correction amount $C_f(0<C_f\leqq 1)$ for use, the approximation of a finally resulting optimum interpolation smoothed spectrogram may be generally improved. Herein, $C_f$ is an amount to correct interference between phases.

Sixth Embodiment

In the third to fifth embodiments, the length of an adaptive window is adjusted (fundamental frequency adaptive frequency analysis portion 107 in FIGS. 13 and 15, and adaptive time window producing portion 139 in FIG. 17). In a sixth embodiment, to secure the operation even if a fundamental frequency for adjusting the length of a window function cannot be stably produced, a method is proposed to adaptively adjust the length of the window function taking advantage of the positional relation of events driving a speech sound waveform in the vicinity of a position to analyze.

A speech sound analysis method as a signal analysis method according to the sixth embodiment will be briefly described. Using optimum smoothing functions on the frequency and time axis as described in conjunction with the third and fourth embodiments, in order to remove the influence of excessive smoothing to the best effect, the length of a window for initially analyzing a speech sound waveform is preferably set in a fixed relation with respect to the fundamental frequency of the speech sound. A window function w(t) satisfying the condition is a Gaussian function such as expression (13) and expression (17), and its Fourier transform $W(\omega)$ is as in expression (14) and expression (18). At most two fundamental periods enter into window function w(t) in expressions (13) or (17) to actually influence an analysis result, and in most of the cases a waveform for only one fundamental period enters. Therefore, in the speech sound analysis method according to the sixth embodiment, for a voiced sound having a clear main excitation, a time interval for two excitations with a current analysis center therebetween is used as $\tau_0$. A detailed description follows.

Figure 23:
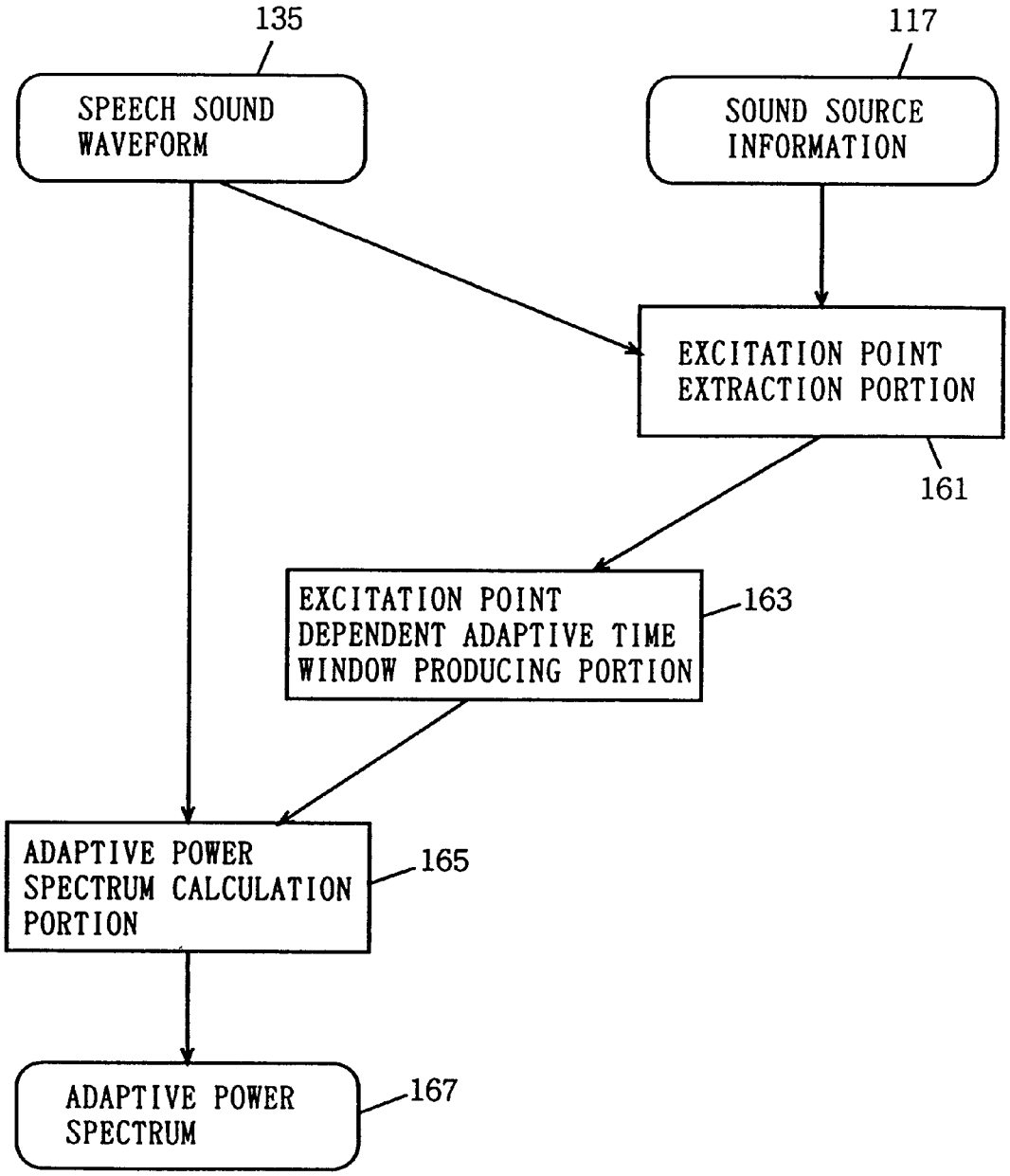
FIG. 23 is a schematic block diagram showing an overall configuration of a speech sound analysis device for implementing a speech sound analysis method according to a sixth embodiment of the invention.
Figure 24:
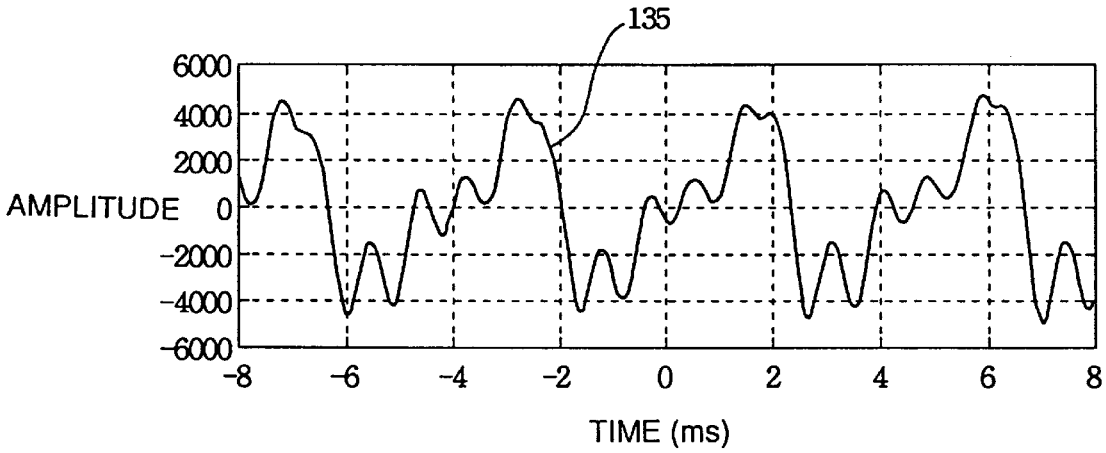
FIG. 24 shows an example of a speech sound waveform in FIG. 23.

FIG. 23 is a schematic block diagram showing an overall configuration of a speech sound analysis device for implementing the speech sound analysis method according to the sixth embodiment. Referring to FIG. 23, the speech sound analysis method includes an excitation point extraction portion 161, an excitation point dependent adaptive time window producing portion 163 and an adaptive power spectrum calculation portion 165. Fundamental frequency adaptive frequency analysis portion 105 in FIGS. 13 and 15 and adaptive time window producing portion 139 in FIG. 17 may be replaced with the speech sound analysis device shown in FIG. 23. In that case, at outline spectrum calculation portion 109 and normalized spectrum calculation portion 111 in FIGS. 13 and 15, an adaptive power spectrum 167 is used in place of a power spectrum obtained at fundamental frequency adaptive frequency analysis portion 107. Sound source information 117 is the same as sound source information 117 in FIG. 13. A speech sound waveform 135 is the same as a speech sound waveform applied from analog/digital converter 103 shown in FIGS. 13 and 15. FIG. 24 shows an example of speech sound waveform 135 shown in FIG. 23. Referring to FIG. 23, the ordinate represents amplitude, the abscissa time (ms).

Figure 25:
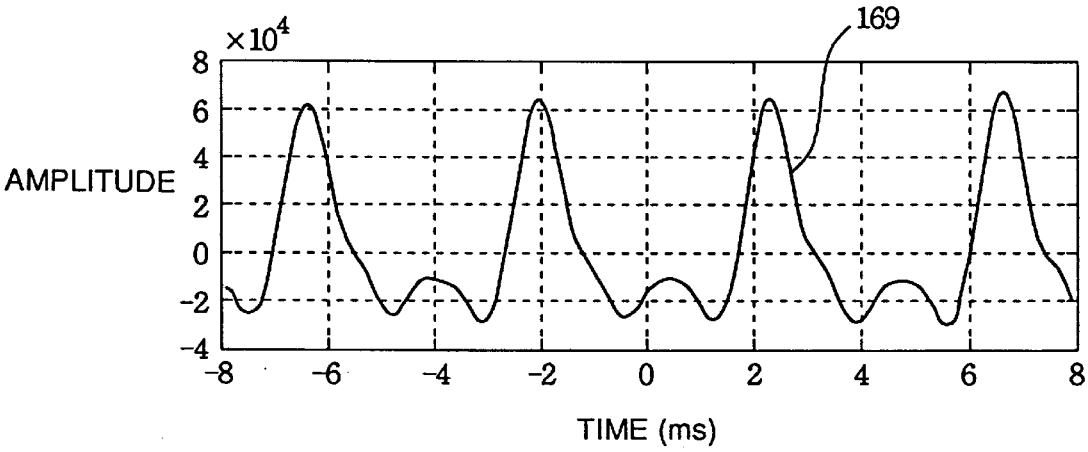
FIG. 25 is a waveform chart showing a signal which takes an maximal value upon a closing of a glottis obtained at an excitation point extraction portion in FIG. 23.

The speech sound analysis device in FIG. 23 produces information on an excitation point in a waveform from a speech sound waveform in the vicinity of an analysis position rather than fundamental frequency information in producing the adaptive time window, and implements the speech sound analysis method for determining an appropriate length of a window function based on the relative relation between the analysis position and the excitation point. At excitation point extraction portion 161, an average fundamental frequency is produced based on reliable values from sound source information 117, and adaptive complementary window functions (window functions produced according to the same method as adaptive complementary window function $w_d(t)$ shown in FIG. 18) corresponding to twice, 4, 8, and 16 times the fundamental frequency are combined while multiplying their amplitudes by $\sqrt{2}$ to produce a function for detecting a closing of a glottis. The function for glottis closing detection is convoluted with the speech sound waveform (refer to FIG. 24) to produce a signal which takes a maximum value at a glottis closing. An excitation point is produced based on the maximal value of the signal. The excitation points correspond to times when the glottis periodically closes. FIG. 25 shows a signal which takes maximum values at glottis closings. The ordinate represents amplitude, and the abscissa time (ms). A curve 169 indicates a signal which takes maximum values at glottis closings.

Referring back to FIG. 23, at excitation point dependent adaptive time window producing portion 163, the length of a window is adaptively determined based on information on the excitation point obtained by excitation point extraction portion 161, assuming that the time interval between excitation points with a current analysis point therebetween is a fundamental period $\tau_0$. At adaptive power spectrum calculation portion 165, the window obtained at excitation point dependent adaptive time window producing portion 163 is used for frequency analysis, and an adaptive power spectrum 167 is produced.

Applying the speech sound analysis method according to the sixth embodiment to the speech sound analysis methods according to the third to fifth embodiments, stable effects can be brought about even if a fundamental frequency for adjusting the length of an adaptive window function cannot be stably produced. More specifically, even if the fundamental frequency for adjusting the length of the adaptive window function cannot be stably produced, the effects of the speech sound analysis methods according to the third to fifth embodiments will not be lost.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of synthesizing a sound, producing an impulse response, based on the product of a phasing component and a spectrum of a source sound, wherein a sound source signal resulting from the phasing component has a power spectrum the same as the impulse and energy distributed in time; and synthesizing said sound from said source sound by adding up said impulse response while moving said response by a period of interest on the temporal axis;

wherein:

said phasing component is a product of a first component and a second component, said first component $\Phi(\omega)$ is represented as follows:

$$\Phi(\omega) = \exp\left(j\rho(\omega)\sum_{k\in\Lambda}\alpha_k \cdot \sin(m_k \cdot \xi(\omega))\right)$$

wherein exp ( ) represents an exponential function, $\omega$ represents an angular frequency, $\xi(\omega)$ represents a continuous odd function, $\Lambda$ represents a set of a finite number of numerals, k represents a single numeral extracted from $\Lambda$, $\alpha_k$ represents a factor, $m_k$ represents a parameter, and $\rho(\omega)$ represents a function indicating a weight, and said second component is produced by the steps of:

obtaining a band-limited random number by convoluting a random number and a band-liming function on the frequency axis;

obtaining a group delay characteristic by multiplying said band-limited random number and a target value for fluctuation of delay time;

obtaining a phase characteristic by integrating said group delay characteristic by a frequency; and multiplying said phase characteristic by an imaginary number unit to produce the exponent of a exponential function.

2. A method of synthesizing a sound, comprising the steps of:

producing an impulse response, based on the product of a phasing component and a spectrum of a source sound, wherein a sound source signal resulting from the phasing component has a power spectrum the same as the impulse and energy distributed in time; and synthesizing said sound from said source sound by adding up said impulse response while moving said response by a period of interest on the temporal axis;

wherein said phasing component is obtained by the steps of:

obtaining a band-limited random number by convoluting a random number and a band-limiting function on the frequency axis;

obtaining a group delay characteristic by multiplying said band-limited random number and a target value for fluctuation of delay time;

obtaining a phase characteristic by integrating said group delay characteristic by a frequency; and multiplying said phase characteristic and an imaginary number unit to produce the exponent of an exponential function.

3. A method of synthesizing a sound, comprising the steps of:

producing an impulse response, based on the product of a phasing component and a spectrum of a source sound, wherein a sound source signal resulting from the phasing component has a power spectrum the same as the impulse and energy distributed in time; and synthesizing said sound from said source sound by adding up said impulse response while moving said response by a period of interest on the temporal axis;

wherein said phasing component is represented as $\Phi(\omega)$ in the following equation:

$$\Phi(\omega) = \exp\left(j\rho(\omega)\sum_{k\in\Lambda}\alpha_k \cdot \sin(m_k \cdot \xi(\omega))\right)$$

wherein exp ( ) represents an exponential function, $\omega$ represents an angular frequency, $\xi(\omega)$ represents a continuous odd function, $\Lambda$ represents a set of a finite number of numerals, k represents a single numeral extracted from $\Lambda$, $\alpha_k$ represents a factor, $m_k$ represents a parameter and $\rho(\omega)$ represents a function indicating a weight.

4. A method of signal analysis, comprising the steps of:

sampling and digitizing a nearly periodic signal;

hypothesizing a time frequency surface representing the sampled, digitized nearly periodic signal, said time frequency surface represented as a product of a piecewise polynomial of time and a piecewise polynomial of frequency;

extracting a prescribed range of said nearly periodic signal using a window function;

producing a first spectrum from said nearly periodic signal in said extracted prescribed range;

producing an optimum interpolation function in the direction of frequency from a representation in the frequency region of said window function and the basis of a space represented by said piecewise polynomial of frequency; and producing a second spectrum by convoluting said first spectrum and said optimal interpolation function in the direction of frequency, wherein said optimum interpolation function in the direction of frequency minimizes an error between said second spectrum and a section along the frequency axis of said time frequency surface.

5. The signal analysis method of claim 4, further comprising transforming said second spectrum into a third spectrum, using a monotonic smoothed function which maps the region of $-\infty$ to $+\infty$ to the region of 0 to $+\infty$.

6. A signal analysis method comprising the steps of:

sampling and digitizing a nearly periodic signal;

hypothesizing a time frequency surface representing the sampled, digitized nearly periodic signal, said time frequency surface represented as a product of a piecewise polynomial of time and a piecewise polynomial of frequency;

extracting a prescribed range of said nearly periodic signal using a window function;

producing a first spectrum from said nearly periodic signal in said extracted prescribed range;

producing an optimum interpolation function in the direction of frequency from a representation in the frequency region of said window function and the basis of a space represented by said piecewise polynomial of frequency;

producing a fourth spectrum by removing the influence of the fundamental frequency of said nearly periodic signal from said first spectrum;

producing a fifth spectrum by dividing said first spectrum by said fourth spectrum;

producing a second spectrum by convoluting said fifth spectrum and said optimal interpolation function in the direction of frequency;

transforming said second spectrum into a third spectrum, using a monotonic smoothed function which maps the region of $-\infty$ to $+\infty$ to the region of 0 to $+\infty$; and producing a sixth spectrum by multiplying said third spectrum by said fourth spectrum, wherein said optimum interpolation function in the direction of frequency minimizes an error between said second spectrum and a section along the frequency axis of said time freguency surface.

7. A signal analysis method comprising the steps of:

producing an optimum interpolation function in the direction of time from a representation of said window function in a time region and the basis of a space represented in said piecewise polynomial of time;

producing a plurality of said second spectra at every arbitrary time;

producing a first spectrogram by arranging said plurality of second spectra in the direction of time;

producing a second spectrogram by convoluting said first spectrogram and said optimum interpolation function in the direction of time, wherein said optimum interpolation function in the direction of time minimizes an error between said second spectrogram and said time frequency surface.

8. A signal analysis method of claim 4, further comprising the steps of:

producing a plurality of said second spectra at each arbitrary time;

transferring said plurality of second spectra to a plurality of third spectra, using a first monotonic smoothed function which maps the region of $-\infty$ to $+\infty$ to the region of 0 to $+\infty$;

producing a first spectrogram by arranging said plurality of third spectra in the direction of time;

producing an optimum interpolation function in the direction of time from a representation of said window function in a time region and the basis of a space represented in said piecewise polynomial of time;

producing a second spectrogram by convoluting said first spectrogram and said optimum interpolation function in the direction of time; and transforming said second spectrogram into a third spectrogram, using a second monotonic smoothed function which maps the region of $-\infty$ to $+\infty$ to the region of 0 to $+\infty$, wherein said optimum interpolation function in the direction of time minimizes an error between said second spectrogram and said time frequency surface.

9. A signal analysis method comprising the steps of:

sampling and digitizing a nearly periodic signal;

hypothesizing a time frequency surface representing the sampled, digitized nearly periodic signal, said time frequency surface represented as a product of a piecewise polynomial of time and a piecewise polynomial of frequency;

extracting a prescribed range of said nearly periodic signal, using a window function;

producing a first spectrum from said nearly periodic signal in said extracted prescribed range;

producing a plurality of said first spectra at each arbitrary time;

producing a plurality of second spectra by removing the influence of the fundamental frequency of said nearly periodic signal from said plurality of first spectra;

producing a plurality of third spectra by dividing said each first spectrum by a corresponding one of said second spectra;

producing an optimum interpolation function in the direction of frequency from a representation of said window function in a frequency region and the basis of a space represented by said piecewise polynomial of said frequency;

producing a plurality of fourth spectra by convoluting each said third spectra and said optimum interpolation function in the direction of frequency;

transforming said plurality of fourth spectra into a plurality of fifth spectra, using a first monotonic smoothed function which maps the region of $-\infty$ to $+\infty$ to the region of 0 to $+\infty$;

producing a plurality of sixth spectra by multiplying each said fifth spectra and a corresponding one of said second spectra;

producing a first spectrogram by arranging said plurality of sixth spectra in the direction of time;

producing a second spectrogram by removing the influence of temporal fluctuation based on the periodicity of said nearly periodic signal from said first spectrogram;

producing a third spectrogram by dividing said first spectrogram by said second spectrogram;

producing an optimum interpolation function in the direction of time from a representation of said window function in a time region and the basis of a space represented in said piecewise polynomial of time;

producing a fourth spectrogram by convoluting said third spectrogram and said optimum interpolation function in the direction of time;

transforming said fourth spectrogram into a fifth spectrogram, using a second monotonic smoothed function which maps the region of $-\infty$ to $+\infty$ to the region of 0 to $+\infty$; and producing a sixth spectrogram by multiplying said fifth spectrogram by said second spectrogram, wherein said optimum interpolation function in the direction of time minimizes an error between said fourth spectrum and a section along the frequency axis of said time frequency surface, and said optimum interpolation function in the direction of time minimizes an error between said fourth spectrogram and said time frequency surface.

10. A signal analysis method, comprising the steps of:

sampling and digitizing a nearly periodic signal;

producing a first spectrum of the sampled, digitized nearly periodic signal whose characteristic changes with time, using a first window function;

producing a second window function, using a prescribed window function;

producing a second spectrum of said nearly periodic signal, using said second window function; and producing an average value of said first spectrum and said second spectrum through transformation by square or a monotonic non-negative function, and making a resultant average value a third spectrum, wherein said step of producing said second window function includes the step of:

positioning said prescribed window functions apart at an interval of a fundamental period on both sides of the origin;

inverting the sign of one of said positioned prescribed window functions; and producing said second window function by combining said sign-inverted prescribed window function and said the other prescribed window function.

11. The signal analysis method of claim 10, further comprising the steps of:

producing a plurality of said third spectra at each arbitrary time; and producing a spectrogram by arranging said plurality of third spectra in the direction of time.

* * * * *